US012024760B2

(12) United States Patent
Liu et al.

(10) Patent No.: US 12,024,760 B2
(45) Date of Patent: Jul. 2, 2024

(54) PRECIPITATION-STRENGTHENED SHAPE MEMORY ALLOYS, DESIGNING METHODS AND APPLICATIONS OF SAME

(71) Applicant: NORTHWESTERN UNIVERSITY, Evanston, IL (US)

(72) Inventors: Chuan Liu, Evanston, IL (US); Gregory B. Olson, Riverswood, IL (US)

(73) Assignee: NORTHWESTERN UNIVERSITY, Evanston, IL (US)

( * ) Notice: Subject to any disclaimer, the term of this patent is extended or adjusted under 35 U.S.C. 154(b) by 0 days.

(21) Appl. No.: 18/109,379

(22) Filed: Feb. 14, 2023

(65) Prior Publication Data

US 2023/0257857 A1 Aug. 17, 2023

Related U.S. Application Data

(60) Provisional application No. 63/309,671, filed on Feb. 14, 2022.

(51) Int. Cl.

| | |
|---|---|
| ***C22C 30/00*** | (2006.01) |
| ***C22C 19/03*** | (2006.01) |
| ***C22F 1/00*** | (2006.01) |
| ***C22F 1/10*** | (2006.01) |
| ***C22F 1/16*** | (2006.01) |

(52) U.S. Cl.

CPC ..... *C22C 30/00* (2013.01); *C22F 1/002* (2013.01); *C22F 1/006* (2013.01); *C22F 1/10* (2013.01); *C22F 1/16* (2013.01); *C22C 19/03* (2013.01)

(58) Field of Classification Search

CPC ..... C22C 19/03; C22C 30/00; C22F 1/006

See application file for complete search history.

(56) References Cited

U.S. PATENT DOCUMENTS 7,316,753 B2 * 1/2008 Jung ..... C22F 1/006 148/402
9,982,330 B2 * 5/2018 Manuel ..... C22C 27/00

OTHER PUBLICATIONS

Jung, Jin-Won. Design of nanodispersion strengthened titanium nickel-base shape memory alloys. Northwestern University, 2003. (Year: 2003).*

Jung, J., G. Ghosh, and G. B. Olson. "A comparative study of precipitation behavior of heusler phase (Ni2TiAl) from B2—TiNi in Ni—Ti—Al and Ni—Ti—Al-X (X= Hf, Pd, Pt, Zr) alloys." Acta Materialia 51.20 (2003): 6341-6357. (Year: 2003).*

(Continued)

*Primary Examiner* — Samir Shah
*Assistant Examiner* — Sean P. O'Keefe
(74) *Attorney, Agent, or Firm* — Locke Lord LLP; Tim Tingkang Xia, Esq.

(57) ABSTRACT

The invention relates to a precipitation-strengthened shape memory alloy (SMA) comprising a composition designed and processed such that the precipitation-strengthened SMA meets property objectives comprising a yield strength being more than about 1500 MPa at room temperature, a transformation temperature in a range of about −15 to 20° C., a misfit in a range of about 0.9-1.1%, wherein the property objectives are design specifications of the precipitation-strengthened SMA.

5 Claims, 21 Drawing Sheets

(56) References Cited

OTHER PUBLICATIONS

Dai Hsu, Derek Hsen, et al. "The effect of aluminum additions on the thermal, microstructural, and mechanical behavior of NiTiHf shape memory alloys." Journal of Alloys and Compounds 638 (2015): 67-76. (Year: 2015).*

Seidel, André, et al. "Additive manufacturing of powdery Ni-based superalloys Mar-M-247 and CM 247 LC in hybrid laser metal deposition." Metallurgical and Materials Transactions A 49 (2018): 3812-3830. (Year: 2018).*

Stopyra, Wojciech, et al. "Laser powder bed fusion of AA7075 alloy: Influence of process parameters on porosity and hot cracking." Additive Manufacturing 35 (2020): 101270. (Year: 2020).*

Opprecht, Mathieu, et al. "A solution to the hot cracking problem for aluminium alloys manufactured by laser beam melting." Acta Materialia 197 (2020) (Year: 2020).*

Liu, Chuan. Design of Fatigue-Resistant NiTi-Based Shape Memory Alloys for Additive Manufacturing. Diss. Northwestern University, 2021. (Year: 2021).*

* cited by examiner

PRECIPITATION-STRENGTHENED SHAPE MEMORY ALLOYS, DESIGNING METHODS AND APPLICATIONS OF SAME

CROSS-REFERENCE TO RELATED PATENT APPLICATION

This application claims priority to and the benefit of U.S. Provisional Patent Application Ser. No. 63/309,671, filed Feb. 14, 2022, which is incorporated herein by reference in its entirety.

STATEMENT AS TO RIGHTS UNDER FEDERALLY-SPONSORED RESEARCH

This invention was made with government support under 70NANB14H012 awarded by the National Institute of Standards and Technology. The government has certain rights in the invention.

FIELD OF THE INVENTION

The invention relates generally to materials, and more particularly, to precipitation-strengthened shape memory alloys, designing methods and applications of the same.

BACKGROUND OF THE INVENTION

The background description provided herein is for the purpose of generally presenting the context of the invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art. The subject matter in the background of the invention section merely represents different approaches, which in and of themselves may also be inventions. Work of the presently named inventors, to the extent it is described in the background of the invention section, as well as aspects of the description that may not otherwise qualify as prior art at the time of filing, are neither expressly nor impliedly admitted as prior art against the invention.

The NiTi alloy, one of the major commercial shape memory alloys (SMAs), is widely applied in medical devices, such as tooth braces, orthodontic wires and self-expandable stents due to high flexibility and plateau stresses over a wide range of strain enabled by superelasticity. NiTi SMAs, however, are known to be difficult in processing and machining due to its high reactivity and high ductility, resulting in simple starting form like plate, wire and rod for complex device fabrication. In the past decade, Additive Manufacturing (AM) has gained significant attention for its ability to build up metallic component of arbitrary geometry from power or wire to near net-shape products. The advanced AM technique, therefore, becomes promising to reduce processing steps from raw materials to final devices, which enables fast processing for patient-matched medical devices (PMD).

Our precipitation-strengthened NiTi-based SMAs is potential candidates as they outperform NiTi SMAs in terms of yield strength, fatigue resistance and bio-compatibility. It would be vital to validate the AM printability of our prototypes. With the new processing route, it is necessary to accelerate redesign and optimization of these materials with computational methods for multiple target properties.

SUMMARY OF THE INVENTION

In one aspect, the invention relates to a precipitation-strengthened shape memory alloy (SMA) comprising a composition designed and processed such that the precipitation-strengthened SMA meets property objectives comprising a yield strength being more than about 1500 MPa at room temperature, a transformation temperature in a range of about −15 to 20° C., a misfit in a range of about 0.9-1.1%, wherein the property objectives are design specifications of the precipitation-strengthened SMA.

In one embodiment, the composition comprises nickel (Ni) in about 50 at. %, and titanium (Ti), hafnium (Hf) and aluminum (Al) in 50 at. %.

In one embodiment, the composition comprises Ni in about 50 at. %, Ti in a range of about 23.6-24.2 at. %, Hf in a range of about 21.8-22 at. % and Al in a range of about 4-4.4 at. %, wherein the precipitation-strengthened SMA comprises an $Ni_{50}Ti_{23.6\text{-}24.2}Hf_{21.8\text{-}22}Al_{4\text{-}4.4}$ alloy.

In one embodiment, the precipitation-strengthened SMA comprises an $Ni_{50}Ti_{23.8}Hf_{21.8}Al_{4.4}$ alloy that is superelastic at room temperature.

In one embodiment, the yield strength is about 1770 MPa at room temperature, the transformation temperature is about −10° C., the misfit about 1.02% and the hot cracking sensitivity about 0.3.

In one embodiment, the precipitation-strengthened SMA comprises an $Ni_{50}Ti_{24}Hf_{22}Al_4$ alloy.

In one embodiment, the yield strength is about 1680 MPa at room temperature, the transformation temperature is about 15° C., the misfit about 1.03%, and the hot cracking sensitivity about 0.3.

In one embodiment, the $Ni_{50}Ti_{24}Hf_{22}Al_4$ alloy aged at about 600° C. for about 10 h is of a B2-$L2_1$ two-phase structure.

In one embodiment, the composition is processed with a heat-treatment process including homogenization and solution treatment at about 1050° C. for about 72 h followed by water quenching; and aging treatment at about 600° C. for about 10 h followed by water quenching.

In one embodiment, the precipitation-strengthened SMA has a maximum recoverable strain about 4.2% in a wide temperature range from room temperature to about 175° C.

In one embodiment, the precipitation-strengthened SMA is printable without any hot cracking via laser melting.

In one embodiment, an optimal processing parameter combination is about 750 mm/s and about 150 W, or about 1000 mm/s and about 200 W for scanning speed and laser power, respectively.

In another aspect, the invention relates to a method for producing a precipitation-strengthened shape memory alloy (SMA), comprising: providing a composition designed according to property objectives of the precipitation-strengthened SMA, wherein the property objectives are design specifications of the precipitation-strengthened SMA; performing homogenization and solution treatment of the composition at a first temperature for a first period of time followed by water quenching to form an ingot; and aging treatment of the ingot at a second temperature for a second period of time followed by water quenching to form the precipitation-strengthened SMA.

In one embodiment, the first temperature is in a range of about 840-1260° C., the first period of time is in a range of about 58-86 h, the second temperature is in a range of about 480-720° C., and the second period of time is in a range of about 8-12 h.

In one embodiment, the first temperature is about 1050° C., the first period of time is about 72 h, the second temperature is about 600° C., and the second period of time is about 10 h.

In one embodiment, the property objectives comprises comprising a yield strength being more than about 1500 MPa at room temperature, a transformation temperature in a range of about −15 to 20° C., a misfit in a range of about 0.9-1.1%.

In one embodiment, the composition comprises Ni in about 50 at. %, Ti in a range of about 23.6-24.2 at. %, Hf in a range of about 21.8-22 at. % and Al in a range of about 4-4.4 at. %, wherein the precipitation-strengthened SMA comprises an $Ni_{50}Ti_{23.6-24.2}Hf_{21.8-22}Al_{4-4.4}$ alloy.

In a further aspect, the invention relates to a method for designing a precipitation-strengthened shape memory alloy (SMA), comprising defining property objectives of the precipitation-strengthened SMA, wherein the property objectives are design specifications of the precipitation-strengthened SMA; designing a composition of the precipitation-strengthened SMA according to the property objectives; and processing the composition to form the precipitation-strengthened SMA that meets the property objectives.

In one embodiment, the processing step comprises performing homogenization and solution treatment of the composition at a first temperature for a first period of time followed by water quenching to form an ingot; and aging treatment of the ingot at a second temperature for a second period of time followed by water quenching to form the precipitation-strengthened SMA.

In one embodiment, the first temperature is in a range of about 840-1260° C., the first period of time is in a range of about 58-86 h, the second temperature is in a range of about 480-720° C., and the second period of time is in a range of about 8-12 h.

In one embodiment, the first temperature is about 1050° C., the first period of time is about 72 h, the second temperature is about 600° C., and the second period of time is about 10 h.

In one embodiment, the property objectives comprises comprising a yield strength being more than about 1500 MPa at room temperature, a transformation temperature in a range of about −15 to 20° C., a misfit in a range of about 0.9-1.1%.

In one embodiment, the composition comprises Ni in about 50 at. %, Ti in a range of about 23.6-24.2 at. %, Hf in a range of about 21.8-22 at. % and Al in a range of about 4-4.4 at. %, wherein the precipitation-strengthened SMA comprises an $Ni_{50}Ti_{23.6-24.2}Hf_{21.8-22}Al_{4-4.4}$ alloy.

These and other aspects of the invention will become apparent from the following description of the preferred embodiment taken in conjunction with the following drawings, although variations and modifications therein may be affected without departing from the spirit and scope of the novel concepts of the invention.

BRIEF DESCRIPTION OF THE DRAWINGS

The following drawings form part of the present specification and are included to further demonstrate certain aspects of the invention. The invention may be better understood by reference to one or more of these drawings in combination with the detailed description of specific embodiments presented herein. The drawings described below are for illustration purposes only. The drawings are not intended to limit the scope of the present teachings in any way.

DETAILED DESCRIPTION OF THE INVENTION

Figure 1:
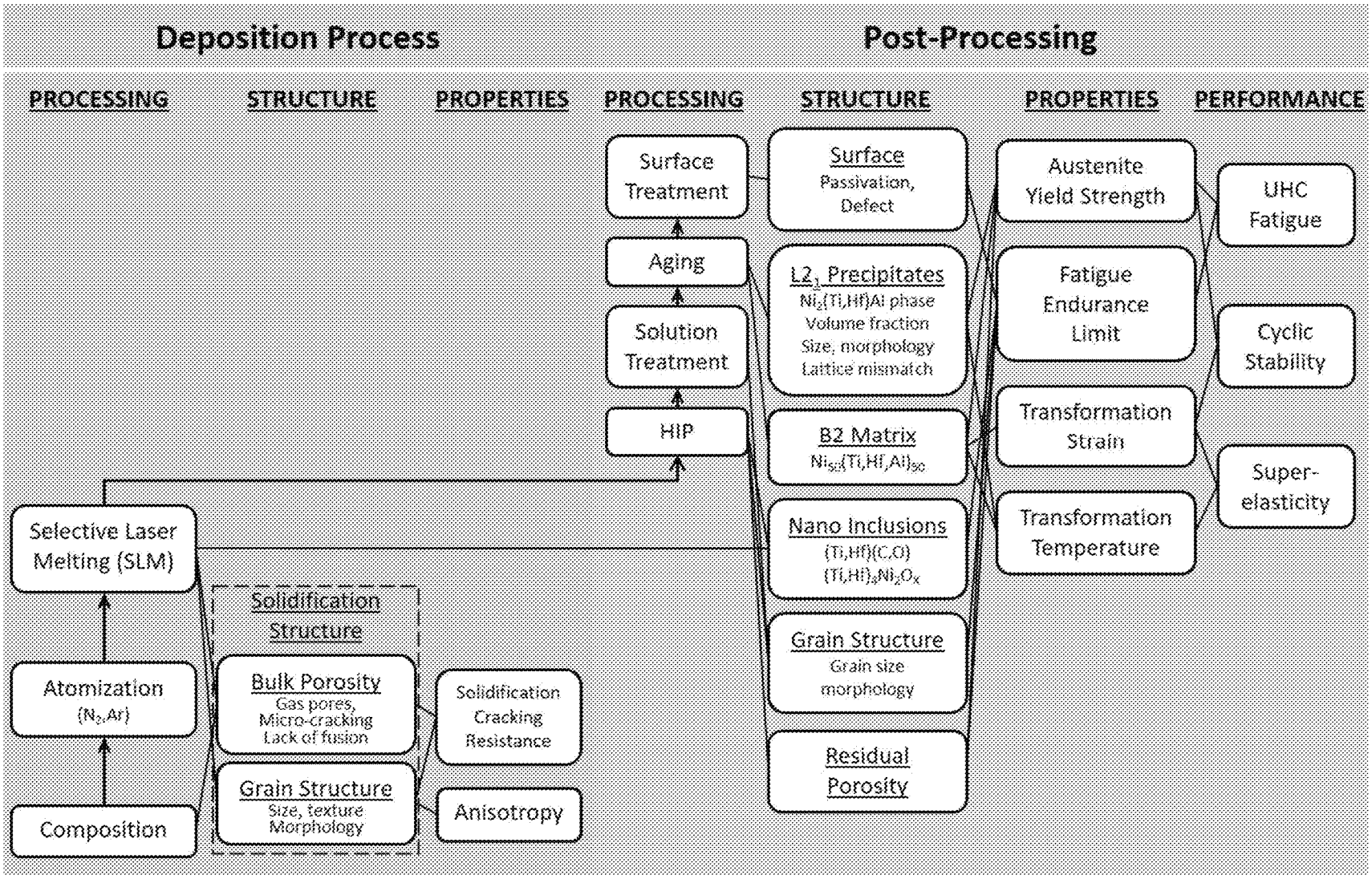
FIG. 1 shows schematically a system design chart of printable NiTiHfAl SMAs for additive manufacturing according to one embodiment of the invention.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

It will be understood that, as used in the description herein and throughout the claims that follow, the meaning of "a", "an", and "the" includes plural reference unless the context clearly dictates otherwise. Also, it will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

It will be further understood that the terms "comprises" and/or "comprising," or "includes" and/or "including" or "has" and/or "having" when used in this specification specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used in this disclosure, "around", "about", "approximately" or "substantially" shall generally mean within 20 percent, preferably within 10 percent, and more preferably within 5 percent of a given value or range. Numerical quantities given herein are approximate, meaning that the term "around", "about", "approximately" or "substantially" can be inferred if not expressly stated.

As used in this disclosure, the phrase "at least one of A, B, and C" should be construed to mean a logical (A or B or C), using a non-exclusive logical OR. As used herein, the term "and/or" includes any and all combinations of one or more of the associated listed items.

Embodiments of the invention are illustrated in detail hereinafter with reference to accompanying drawings. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

One of the objectives of this invention is to provide designs of precipitation-strengthened shape memory alloys for additive manufacturing.

In one aspect, the invention relates to a precipitation-strengthened shape memory alloy (SMA) comprising a composition designed and processed such that the precipitation-strengthened SMA meets property objectives comprising a yield strength being more than about 1500 MPa at room temperature, a transformation temperature in a range of about −15 to 20° C., a misfit in a range of about 0.9-1.1%, wherein the property objectives are design specifications of the precipitation-strengthened SMA.

In certain embodiments, the composition comprises nickel (Ni) in about 50 at. %, and titanium (Ti), hafnium (Hf) and aluminum (Al) in 50 at. %.

In certain embodiments, the composition comprises Ni in about 50 at. %, Ti in a range of about 23.6-24.2 at. %, Hf in a range of about 21.8-22 at. % and Al in a range of about 4-4.4 at. %, wherein the precipitation-strengthened SMA comprises an $Ni_{50}Ti_{23.6\text{-}24.2}Hf_{21.8\text{-}22}Al_{4\text{-}4.4}$ alloy.

In certain embodiments, the precipitation-strengthened SMA comprises an $Ni_{50}Ti23.8Hf_{21.8}Al_{4.4}$ alloy that is superelastic at room temperature.

In certain embodiments, the yield strength is about 1770 MPa at room temperature, the transformation temperature is about −10° C., the misfit about 1.02% and the hot cracking sensitivity about 0.3.

In certain embodiments, the precipitation-strengthened SMA comprises an $Ni_{50}Ti_{24}Hf_{22}Al_4$ alloy.

In certain embodiments, the yield strength is about 1680 MPa at room temperature, the transformation temperature is about 15° C., the misfit about 1.03%, and the hot cracking sensitivity about 0.3.

In certain embodiments, the $Ni_{50}Ti_{24}Hf_{22}Al_4$ alloy aged at about 600° C. for about 10 h is of a B2-$L2_1$ two-phase structure.

In certain embodiments, the composition is processed with a heat-treatment process including homogenization and solution treatment at about 1050° C. for about 72 h followed by water quenching; and aging treatment at about 600° C. for about 10 h followed by water quenching.

In certain embodiments, the precipitation-strengthened SMA has a maximum recoverable strain about 4.2% in a wide temperature range from room temperature to about 175° C.

In certain embodiments, the precipitation-strengthened SMA is printable without any hot cracking via laser melting.

In certain embodiments, an optimal processing parameter combination is about 750 mm/s and about 150 W, or about 1000 mm/s and about 200 W for scanning speed and laser power, respectively.

In another aspect, the invention relates to a method for producing a precipitation-strengthened shape memory alloy (SMA), comprising: providing a composition designed according to property objectives of the precipitation-strengthened SMA, wherein the property objectives are design specifications of the precipitation-strengthened SMA; performing homogenization and solution treatment of the composition at a first temperature for a first period of time followed by water quenching to form an ingot; and aging treatment of the ingot at a second temperature for a second period of time followed by water quenching to form the precipitation-strengthened SMA.

In certain embodiments, the first temperature is in a range of about 840-1260° C., the first period of time is in a range of about 58-86 h, the second temperature is in a range of about 480-720° C., and the second period of time is in a range of about 8-12 h.

In certain embodiments, the first temperature is about 1050° C., the first period of time is about 72 h, the second temperature is about 600° C., and the second period of time is about 10 h.

In certain embodiments, the property objectives comprises comprising a yield strength being more than about 1500 MPa at room temperature, a transformation temperature in a range of about −15 to 20° C., a misfit in a range of about 0.9-1.1%.

In certain embodiments, the composition comprises Ni in about 50 at. %, Ti in a range of about 23.6-24.2 at. %, Hf in a range of about 21.8-22 at. % and Al in a range of about 4-4.4 at. %, wherein the precipitation-strengthened SMA comprises an $Ni_{50}Ti_{23.6\text{-}24.2}Hf_{21.8\text{-}22}Al_{4\text{-}4.4}$ alloy.

In a further aspect, the invention relates to a method for designing a precipitation-strengthened shape memory alloy (SMA), comprising defining property objectives of the precipitation-strengthened SMA, wherein the property objectives are design specifications of the precipitation-strengthened SMA; designing a composition of the precipitation-strengthened SMA according to the property objectives; and processing the composition to form the precipitation-strengthened SMA that meets the property objectives.

In certain embodiments, the processing step comprises performing homogenization and solution treatment of the composition at a first temperature for a first period of time followed by water quenching to form an ingot; and aging treatment of the ingot at a second temperature for a second period of time followed by water quenching to form the precipitation-strengthened SMA.

In certain embodiments, the first temperature is in a range of about 840-1260° C., the first period of time is in a range of about 58-86 h, the second temperature is in a range of about 480-720° C., and the second period of time is in a range of about 8-12 h.

In certain embodiments, the first temperature is about 1050° C., the first period of time is about 72 h, the second temperature is about 600° C., and the second period of time is about 10 h.

In certain embodiments, the property objectives comprises comprising a yield strength being more than about 1500 MPa at room temperature, a transformation temperature in a range of about −15 to 20° C., a misfit in a range of about 0.9-1.1%.

In certain embodiments, the composition comprises Ni in about 50 at. %, Ti in a range of about 23.6-24.2 at. %, Hf in a range of about 21.8-22 at. % and Al in a range of about 4-4.4 at. %, wherein the precipitation-strengthened SMA comprises an $Ni_{50}Ti_{23.6\text{-}24.2}Hf_{21.8\text{-}22}Al_{4\text{-}4.4}$ alloy.

These and other aspects of the invention are further described below. Without intent to limit the scope of the invention, exemplary instruments, apparatus, methods, and their related results according to the embodiments of the invention are given below. Note that titles or subtitles may be used in the examples for convenience of a reader, which in no way should limit the scope of the invention. Moreover, certain theories are proposed and disclosed herein; however, in no way they, whether they are right or wrong, should limit the scope of the invention so long as the invention is practiced according to the invention without regard for any particular theory or scheme of action.

CALPHAD-Based Computational Materials Design Approach

In one exemplary embodiment, the alloy design composition space relates to, but is not limited to, the Ni—Ti—Hf—Al system. It has been established that addition of Al allows formation of nano-precipitates of the Heusler phase ($L2_1$ structure). The Heusler phase is composed of $Ni_2TiAl$ in stoichiometric ratio with an ordered body-centered cubic structure. The Heusler phase is stabilized ranging from $(NiAl)_{0.86}(NiTi)_{0.14}$ to $(NiAl)_{0.1}(NiTi)_{0.9}$. The precipitation hardening can be achieved by controlling precipitate radius and fraction as functions of aging time and temperature.

The highly stabilized B2 phase from adding Al is balanced by adding B19 or B19' stabilizer, such as Pd, Pt, Au, Zr or Hf to set the reverse transformation temperature at room temperature. It is well known that Pd, Pt, and Au stabilize the orthorhombic B19 martensite, which elements frequently apply to high-temperature SMAs focusing on the aerospace field. The elements have an advantage of the large transformation temperature range, 100-530° C. for the Ti—Ni—Pd system, and 100-1100° C. for the Ti—Ni—Pt system. Hf and Zr stabilize B19' martensite, these elements provide lower materials cost compared to the Pd, Pt, and Au. When Zr and Hf are compared, the Zr tends to stabilize the liquid phase, causing service restriction of homogenization and aging temperatures. In the present example, Hf is selected according to cost efficiency. Adding Hf into the NiTi system is known to lead to formation of spindle-like precipitations, so called as an H phase (Han-phase). The H phase stabilizes with increasing in NiHf, and forms between $(NiTi)_{0.8}(NiHf)_{0.2}$ and $(NiTi)_{0.6}(NiHf)_{0.4}$. In the present alloy design, the competition between the Heusler phase and the H phase is considered.

As discussed above, compared to other potential precipitation-strengthened SMAs, NiTiHfAl is of more interest to additive manufacturing due to its higher strength and much lower price. A systematic design approach is used in our design of printable NiTiHfAl SMAs, as shown in the system design chart of FIG. 1 that illustrates the importance of the processing-structure-properties-performance relationship in this material design project, according to embodiments of the invention. To achieve the ideal printable SMA, minimum requirements in fatigue resistance, strength, superelasticity must be achieved. These properties are controlled by system structures involving matrix composition, martensite crystal structure, precipitation strengthening, inclusion and solidification temperature range. Special processing treatments are therefore needed for achieving the necessary structure.

Figure 2:
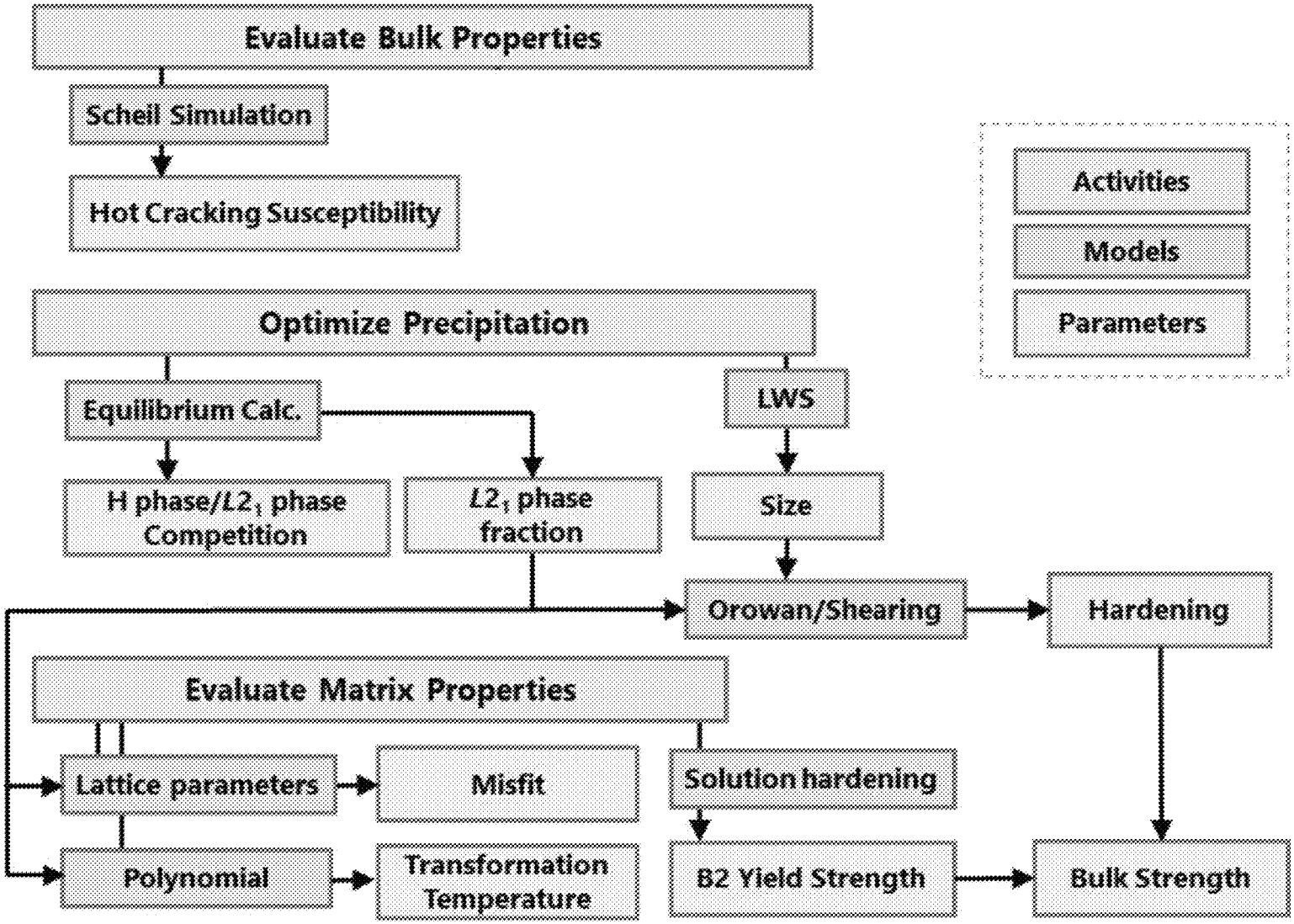
FIG. 2 shows schematically a design flowchart for printable NiTiHfAl SMAs according to embodiments of the invention.
Figure 3:
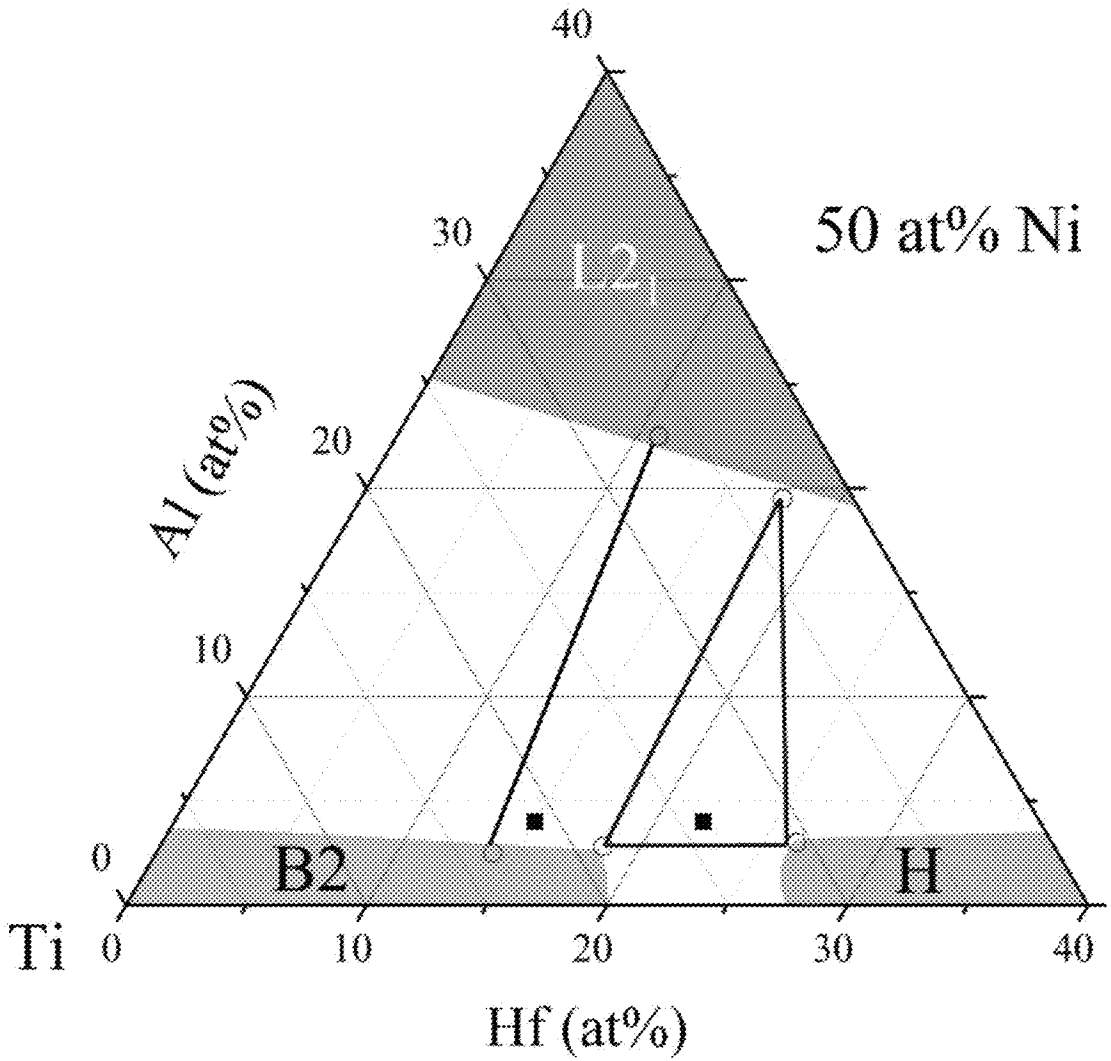
FIG. 3 shows schematically an experimental phase diagram of $Ni_{50}(Ti, Hf, Al)_{50}$ pseudo-ternary system showing the co-existence of B2, $L2_1$ and H phases according to embodiments of the invention.

FIG. 2 shows a flow chart for design of the printable precipitation-hardened shape memory alloy according to embodiments of the invention. The colors of boxes in green, blue, orange represent categories of activities, models and results/parameters, respectively. First, hot cracking sensitivity (HCS) was evaluated because those parameters only depend on bulk composition. Secondary, parameters of precipitations were optimized. A matrix composition and phase fractions of the Heusler phase and the H phase after a heat treatment at various temperature were calculated by equilibrium calculation using by Thermo-calc. The size of the Hesuler phase is calculated using the Lifshitz-Slyozov-Wagner (LSW) model. Misfit was calculated using lattice parameters given by the compositions of matrix and the Heusler phase. Transformation temperature was calculated using the matrix composition and fraction of the Heusler phase based on the Redlich-Kister polynomial with a linear correction term. B2 yield strength was calculated as the sum of solution strengthening contribution based on the matrix composition, and the precipitation hardening term calculated using the fraction and the size of the Hesuler phase. The printability is predicated from HSC values from non-equilibrium solidification thermodynamics.

CALPHAD and Thermodynamic Modeling: To accelerate the design of the printable precipitation-strengthened NiTiHfAl SMAs, Calculation of Phase Diagram (CALPHAD) was adopted as the critical method of microstructure simulation. The Thermo-Calc software (Sweden) has over the past 30 years gained a world-wide reputation as the best and most powerful software package for thermodynamic and properties calculations. The current version of Thermo-Calc software, however, has no available specific database for NiTi-base alloys. Based on a previous NiTi-based database developed by Xuyang Wang at Northwestern University, a new thermodynamic database of Ni—Ti—Hf—Zr—Al—Pd elements was developed in collaboration between Northwestern University and QuesTek LLC. In this database, the sublattice models were selected as $(Ni,Ti,Al,Hf,VA)_{0.5}(Ni,Ti,Al,Hf,VA)_{0.5}(VA)_3$ for B2 phase and $(Ni,VA)_1(Ti,Al)_{0.5}(Ni,Ti,Al,Hf)_{0.5}$ for $L2_1$ phase. To the best knowledge of the inventors, there was no published thermodynamic description of the H-phase until now. In our database, the first sublattice model of the H-phase was developed as $Ni_{0.52}Ti_{0.147}Hf_{0.27}(Hf,Ti,Al)_{0.063}$ in account of available experimental and calculation results.

Strengthening Model: The total strength is modeled as the sum of base strength and strengthening contribution from all the strengthening methods included. In our study, no work hardening or grain refinement has been employed and only solid solution strengthening and precipitation strengthening are supposed to be considered. Therefore, the total strength is express as:

$$\sigma_y=\sigma_{base}+\Delta\sigma_{ss}+\Delta\sigma_{ppt}$$

where $\sigma_y$ is the total yield strength, $\sigma_{base}$ is the yield strength of the base alloy, NiTi, and $\Delta\sigma_{ss}$ and $\Delta\sigma_{ppt}$ are strengthening contributions from solid solution and precipitation, respectively. The base strength of NiTi is supposed to be 800 MPa as the yield strength of solution treated NiTi alloys. The solid solution strengthening effect of an alloying element is expressed by the following equation:

$$\Delta\sigma_{ss}=k_i\times C_i^{n_i}$$

where $k_i$ is solute strengthening coefficient, $C_i$ is the atomic concentration, and $n_i$ is the exponent for alloying element i. The parameters for various alloying elements in NiTi are summarized in Table 1 from published data. The exponent was supposed to be ½ for most strengthening alloying element except for Pd due to its softening effect. There was little published data on the strengthening effect of Hf solutes in B2 NiTi matrix. Hf addition, known as a strong martensite stabilizer, results in the B19' martensite phase at room temperature. The strengthening of Hf solutes in B2 NiTi is only obtained from mechanical test on temperature much higher than the corresponding $A_f$ transformation temperature. We estimated the solute strengthening coefficient, $k_{Hf}$, to be 1280 MPa with subtracting the yield strength of solution treated $Ni_{50}Ti_{31}Hf_{15}Al_4$ by the base strength and the contribution from Al solute strengthening. It is worthwhile to mention here that it might be not so reasonable to assume a linear sum of solid solution strengthening from various alloying elements. As we observed from the hardness test, $Ni_{50}Ti_{30}Hf_{15}Al_5$ was of much higher strength than $Ni_{50}Ti_{31}Hf_{15}Al_4$ in the solution treated condition, which could not be explained by the minor difference in Al content. This might be attributed to the variation in the base strength or the nonlinear sum of multiple solutes strengthening.

TABLE 1

Fitted empirical solid solution strengthening coefficients and exponents for Al, Zr, Hf, Pd in B2 NiTi

| | $k_i$ (MPa) | $n_i$ |
|---|---|---|
| Al | 2575 | ½ |
| Zr | 2730 | ½ |
| Hf | 1280 | ½ |
| Pd | −297 | 1 |

The precipitation strengthening is more complicated as the result of competition between different dislocation-precipitate interaction mechanisms depending on precipitate size. At small precipitate size, dislocations prefer cutting through the precipitates and the strengthening effect is simplified as $$\Delta\sigma_{ppt}^{shear}=K1\times f^{1/2}\times r^{n}$$

where K1 is the shearing strengthening coefficient, f is the volume fraction of precipitates, and r is the precipitate radius, n is an exponent. The exponent, n, was determined to be ½ in the precipitation strengthening modeling of NiTiZrAl and PdNiTiAl alloys by Bender and Jiang. Nevertheless, the prediction from modeling always deviated from the experimental results, suggesting that n=1 might be more appropriate as proposed by Frankel. In this case, the shearing strengthening coefficient, K1, was determined to be 1419.1 and 491.3 MPa/nm for NiTiZrAl and PdNiTiAl, respectively. K1 was mostly affected by the shear modulus of matrix and precipitate phases, and the Burger's vector in the matrix.

With larger precipitates, the shearing mechanism is energetically unfavorable as the crossing area increased as the square of precipitate size. Dislocations preferentially bypass precipitates by leaving a dislocation loop at precipitates, which was named as Orowan looping. As no dislocation into precipitates, the strengthening effect of Orowan looping depends on physical properties of the matrix. And it is simply expressed as:

$$\Delta\sigma_{ppt}^{loop} = K2\times\frac{f^{1/2}}{r}$$

where K2 is the looping strengthening coefficient determined by the Burger's vector and the shear modulus of matrix. And it was determined to be 3089.4 MPa nm consistently in previous analysis of Heusler strengthening in NiTiZrAl and PdNiTiAl.

From the equations for shearing strengthening and looping strengthening, shearing strengthening increases with increasing monotonously while looping strengthening decreased monotonously. The cross point at $r=r_{opt}$ is the regime boundary for which mechanism dominates, and it also defines the highest precipitation strengthening is achieved in the material. In comparison between different material, the shearing strengthening coefficient, K1, determined which is of potential in higher precipitation strengthening.

Figure 4:
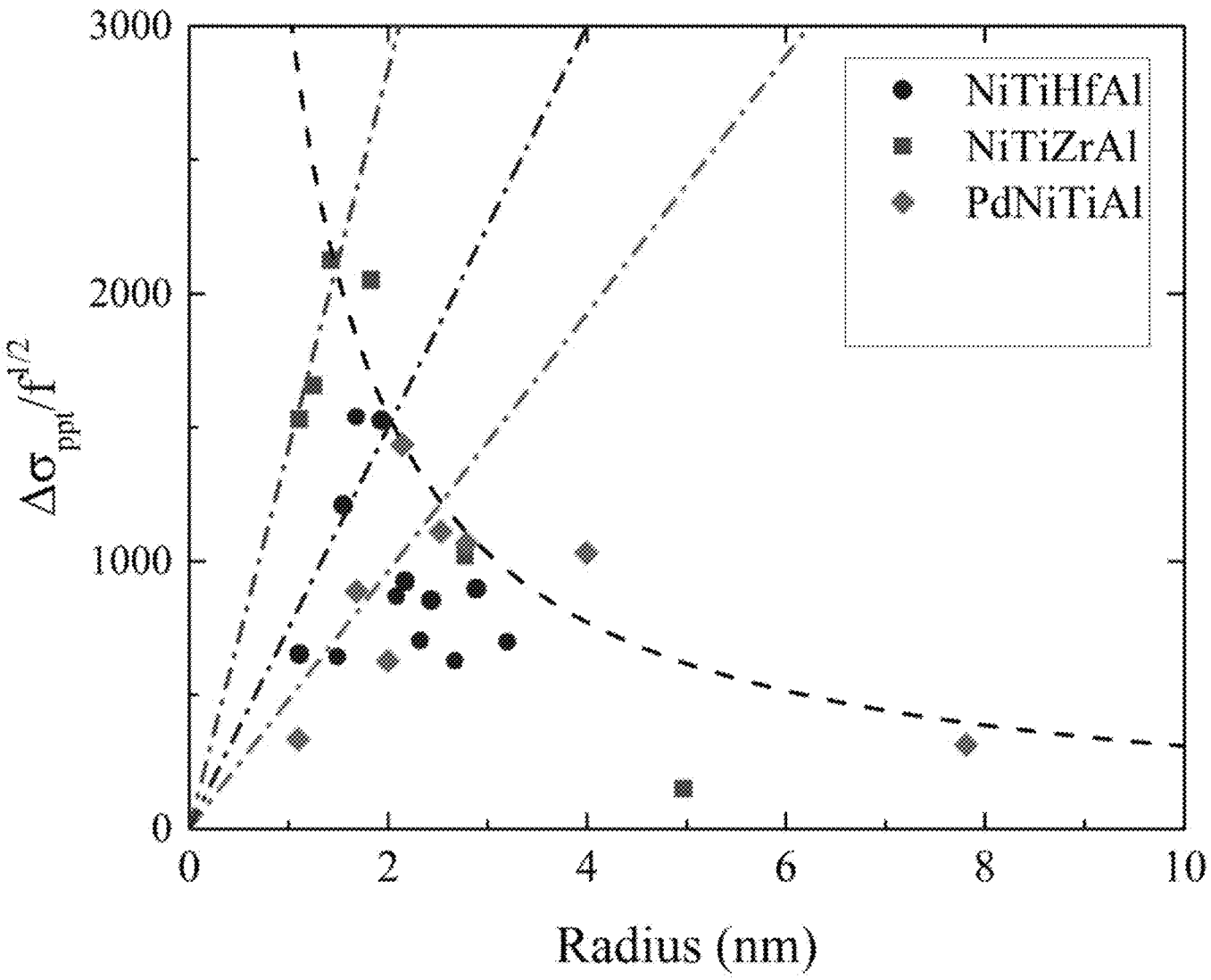
FIG. 4 shows precipitations strengthening of the $L2_1$ Heusler phase in the B2 matrix for different prototypes: $Ni_{50}Ti_{38}Zr_8Al_4$ aged at 600° C.; $Pd_{20}Ni_{30}Ti_{46}Al_4$ aged at 550° C.; and $Ni_{50}Ti_{35-x}Hf_{15}Al_x$ (x=4,5) aged at 550° C., according to embodiments of the invention.

In combination with phase composition revealed by APT analysis, the strengthening contribution is separated from others by subtracting the solid solutions strengthening from the total strength change after aging. Considering the phase fraction of precipitates, the correlation between precipitation strengthening $\Delta\sigma_{ppt}/f^{1/2}$ and precipitate size, r was presented in FIG. 4. And K1 was determined to be 873 MPa/nm, falling between the values for NiTiZrAl and PdNiTiAl alloys. As discussed before, K2 was supposed to be invariant in the class of same strengthening system. Therefore, the optimal radius for highest strengthening, was calculated to be 1.88 nm. However, all points for overaged conditions fell below the looping curve defined by K2=3089.4 MPa nm, suggesting K2 might be smaller in NiTiHfAl alloys.

Capillary Effect on Phase Composition The composition of the B2 and $L2_1$ precipitate phase is calculated by the Gibbs-Thompson model at the optimal radius. The composition change follows the Gibb-Thomson trajectories in dilute solutions, as given by the following relationship:

$$C_r^i = A*\exp\left(\frac{r}{b}\right)$$

The experimental data for the Gibbs-Thomson plot for composition trajectory vs. 1/R in different phase are obtained from obvious work. This data is fitted to the following equation to obtain the value of constants in the exponential term. And the composition of phases formed in the NiTiHfAl system can be found in Table. 4.

$$b = \frac{2\gamma Vm}{RT}$$

Gibbs-Thomson trajectories for the NiTiHfAl system characterized in with Atom Probe Tomography are summarized in Table 2.

TABLE 2

Experiment data for of phase composition in $NiTiHf_{15}A1_4$ from previous work

| | B2 | | $L2_1$ | |
|---|---|---|---|---|
| Component | A(at %) | b(nm) | A(at %) | b(nm) |
| Ni | 48.54 | 0.0434 | 53.63 | −0.0826 |
| Ti | 33.65 | −0.0936 | 11.59 | 0.7653 |
| Hf | 14.99 | −0.0368 | 14.50 | −0.0542 |
| Al | 2.72 | 0.3907 | 22.88 | −0.5368 |

Figure 5:
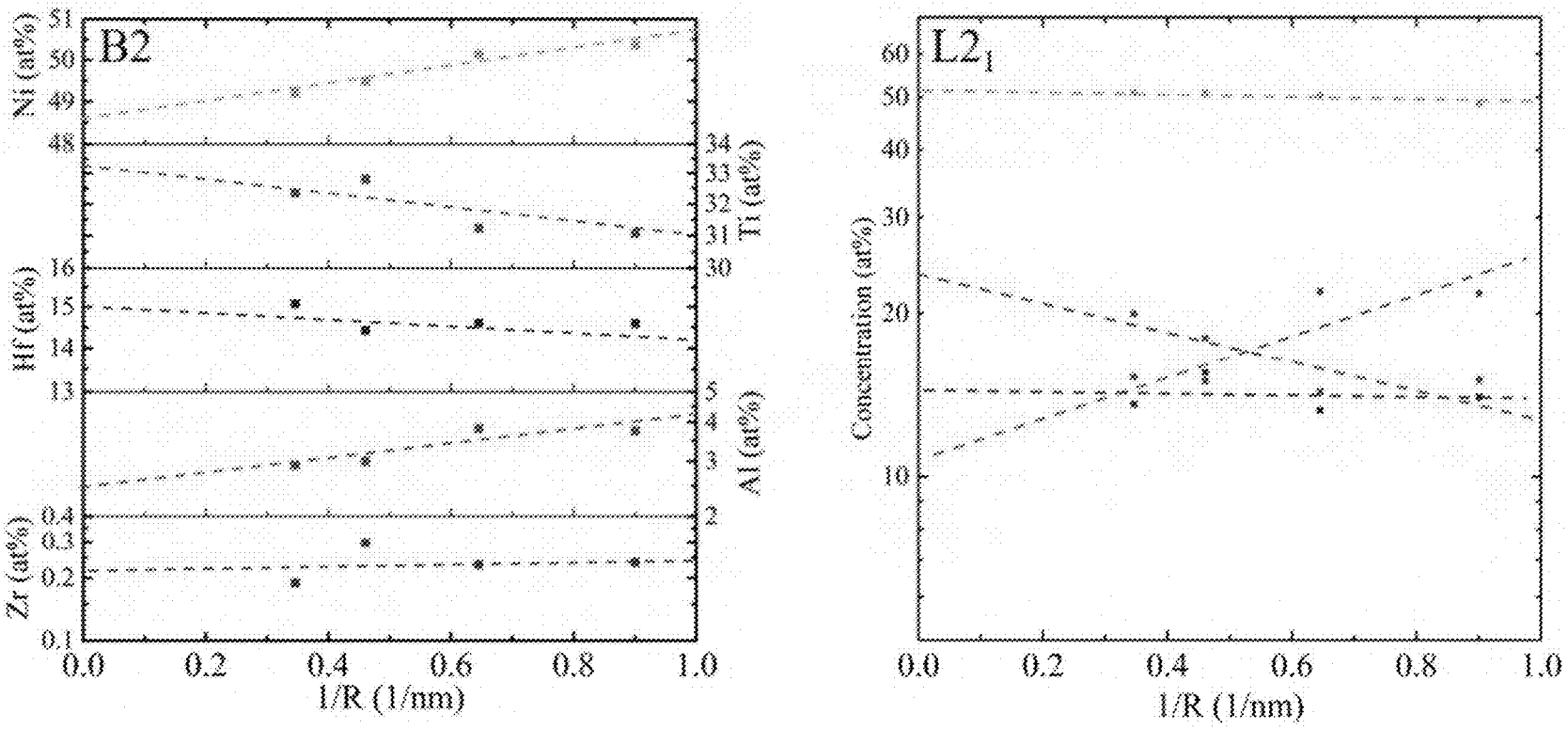
FIG. 5 shows Gibbs-Thomson plots for composition trajectory vs 1/R according to embodiments of the invention. Atomic composition of elemental components in the B2 phase and $L2_1$ phase is plotted versus the inverse of the measured average radius for various aging treatments, along with fitted Gibbs-Thomson curves for $NiTiHf_{15}Al_4$ annealed at 550° C.
Figure 6:
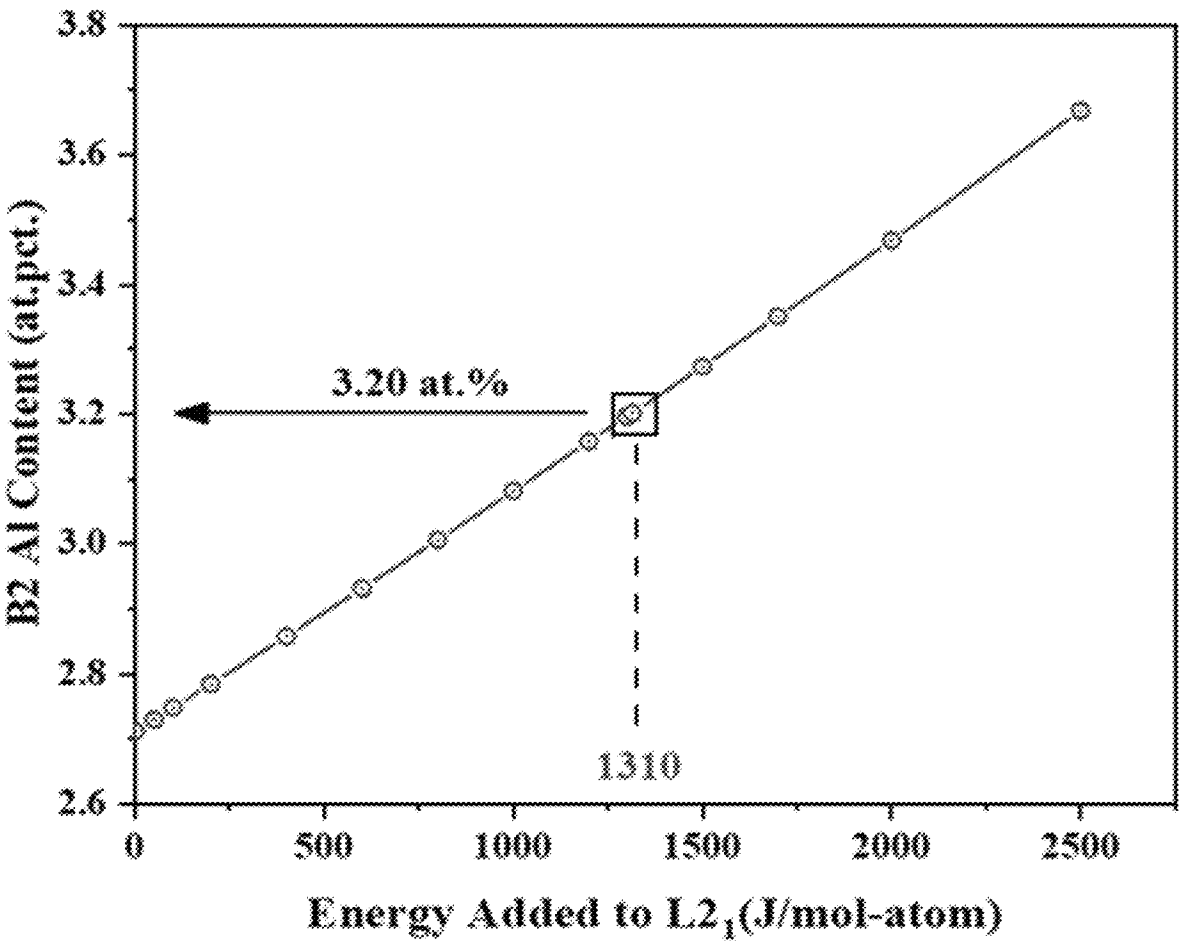
FIG. 6 shows the relationship of Al content in B2 phase and the energy added to $L2_1$ phase according to embodiments of the invention.

The concentration of different atoms in the B2 phase and the $L2_1$ phase are shown in FIG. 5. The atom concentration of Al is about 3.2%. FIG. 6 shows the relationship between the Al concentration in the B2 phase and the energy need to be added to the $L2_1$ phase. The value of the energy need to be added to the $L2_1$ phase is about 1310 J/mol-atom.

Transformation Temperature Model: A model predicting $A_f$ is described by the Redlich-Kister polynomial. Experimentally reported $A_f$ is fitted and extrapolated by the polynomial, as a substitutional regular solution model with sublattice system. Salzbrenner and Cohen reported the relationship among $M_s$, $A_f$ and $T_0$ in single crystals and polycrystalline thermoelastic SMA. According to the report, the $A_f$ in the polycrystalline SMA can be approximated to $T_0$ in the single crystal, and can be described by the substitutional regular solution model. On the other hand, it is well known that elastic energy stored around the precipitation decreases $A_f$. Nearly linear relationship has been reported between $A_f$ and a fraction of the Heusler phase. Thus, the $A_f$ can be expressed as the Redlich-Kister polynomial with linear correction term as following:

$$A_f = \sum_{i \neq j} x_i x_j A_{f(i;j)} + \sum_{i \neq j \neq k} x_i x_j x_k L^0_{(i;j,k)} + \sum_{i \neq j \neq k} x_i x_j x_k L^1_{(ij,k)}(x_j - x_k) + A^0_{f(\Delta E_{el})} f_{(L2_1)}$$

where $x_i$, $x_j$, $x_k$ are molar fraction of element i, j, k, $A_{f(i;j)}$ is an endpoint as $A_f$ for binary systems of i in sublattice I and j in sublattice II, and $L_{(i;j,k)}{}^0$ is an interaction parameter for ternary system of is i:j, k with k in sublattice II. $f_{(L2_1)}$ is a fraction of Heusler phase and $A_{f(\Delta E_{el})}$ is a coefficient in the linear correlation term. The coefficient is expected to be negative because the stored elastic energy promotes reverse transformation leading a decrease in $A_f$. Matrix compositions after aging were calculated by equilibrium calculation and were used for the $A_f$ calculation.

Figure 7:
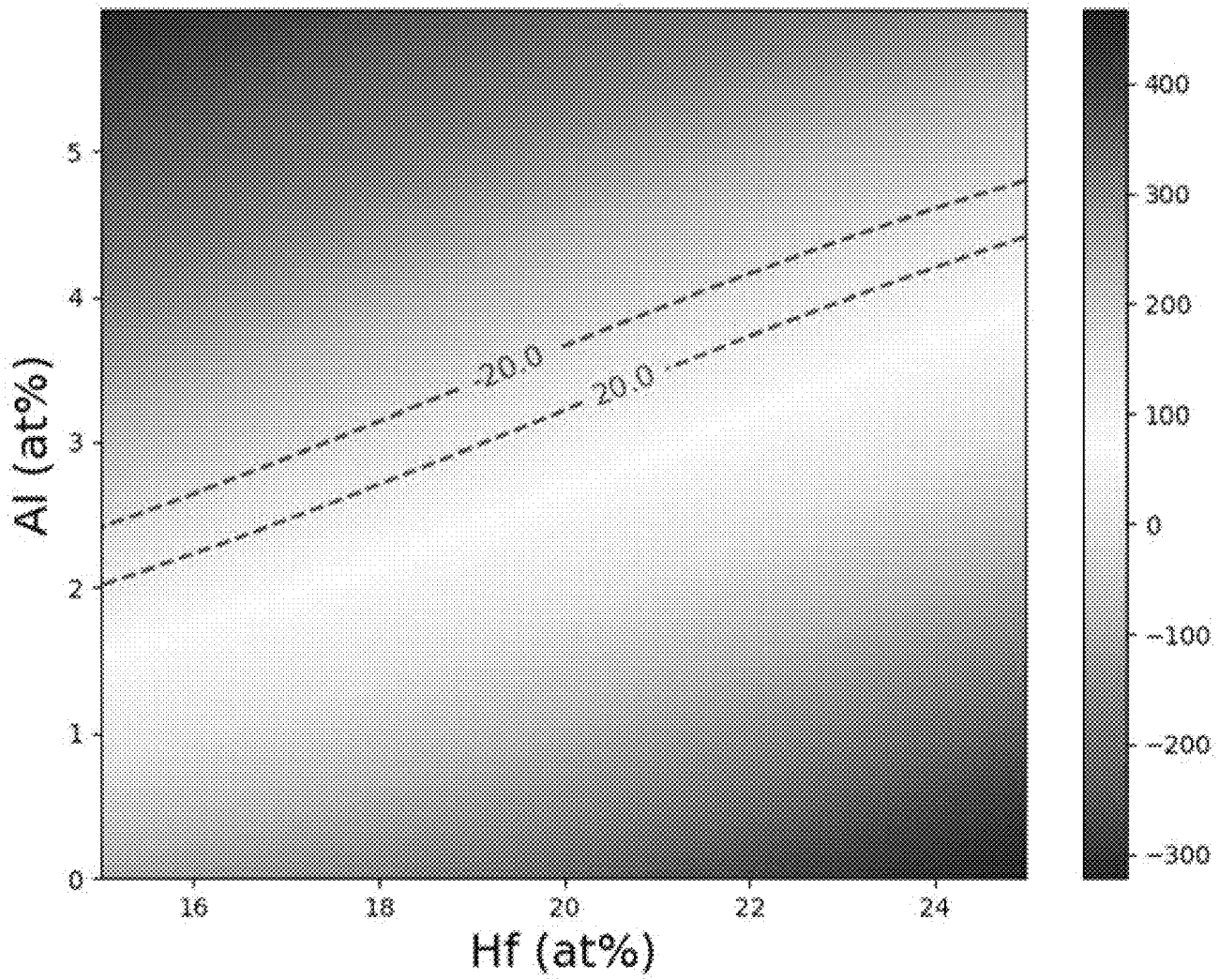
FIG. 7 shows the $A_f$ transformation temperature map of solution-treated $Ni_{50}(Ti, Hf, Al)_{50}$ alloys according to embodiments of the invention.

A linear regression fitting was performed with current experimental results and published data on NiTi, NiTiHf, NiTiAl SMAs. The fitting values for all coefficients were summarized in the table below. And with these fitting values, a map of transformation temperature, $A_f$, was calculated and shown in FIG. 7, in which two dashed lines represented the desired temperature window. The coefficient of $A_{f(\Delta E_{el})}$ was determined as −1075.

TABLE 3

Endpoints of reverse transformation temperatures in a binary system

| System | Symbol | Parameter |
|---|---|---|
| Ni:Ti | $A_{f(Ni:Ti)}$ | 114 |
| Ni:Hf | $A_{f(Ni:Hf)}$ | 1507.1 |
| Ni:Al | $A_{f(Ni:Al)}$ | −19113 |

TABLE 4

Interaction parameters in ternary systems

| System | Symbol | Parameter |
|---|---|---|
| Ni:(Ti, Hf) | $L^0_{(Ni:Ti,\ Hf)}$ | −1464 |
| | $L^1_{(Ni:Ti,\ Hf)}$ | 299.8 |
| Ni:(Ti, Al) | $L^0_{(Ni:Ti,\ Al)}$ | 29679 |
| | $L^1_{(Ni:Ti,\ Al)}$ | −21689 |
| Ni:(Hf, Al) | $L^0_{(Ni:Hf,\ Al)}$ | 7630 |
| | $L^1_{(Ni:Hf,\ Al)}$ | 2894 |

Misfit Model: The unconstrained interphase misfit (in percent) between the B2 matrix phase and the $L2_1$ precipitate phase is calculated by the relation:

$$\delta = \left(\frac{a_{L2_1} - 2a_{B2}}{2a_{B2}}\right) \times 100$$

In the ternary NiTiAl system, the lattice parameter for the B2 phase (NiTi)=0.3010 nm and the lattice parameter for the $L2_1$ phase ($Ni_2TiAl$)=0.58 nm. The composition-dependent lattice parameters may be calculated using a weighted sum of the known atomic volumes of the constituents in the B2 and $L2_1$ phases and the misfit can be calculated from the cube root of the ratio of the average atomic volume for each phase 65 nm are known and the misfit can be calculated to be −2.57%. For higher order systems:

$$\delta = \sqrt[3]{\frac{\bar{\Omega}_{L2_1}}{\bar{\Omega}_{B2}} - 1}\Bigg) \times 100$$

$$\bar{\Omega}_{L2_1} = \sum_{i=1}^{n} x_i \Omega_i^{L2_1}$$

$$\bar{\Omega}_{B2} = \sum_{i=1}^{n} x_i \Omega_i^{B2}$$

where x represents the mole fraction of a certain element in the corresponding phase, $\Omega_i$ represents the atomic volume of element i in the corresponding phase, and $\Omega$ is the average atomic volume.

The average atomic volumes of Ni, Ti, Al and Hf in the B2 and $L2_1$ phases can be determined by x-ray diffraction data performed on experimental alloys according to the literature. Table. 5 shows the atomic volumes. Atomic volume was derived based on lattice spacing by utilizing a simplifying assumption that atomic volume is not dependent on the lattice site that an atom occupies.

TABLE 5

Measured and calculated atomic volumes at 25° C. for atomic species in the B2 and $L2_1$ phases.

| Specie | Ni | Ti | Hf | Al |
|---|---|---|---|---|
| $\Omega_i^{B2}$(nm$^3$) | 0.0123 | 0.0151 | 0.0206 | 0.0114 |
| $\Omega_i^{L2_1}$(nm$^3$) | 0.0115 | 0.0157 | 0.0245 | 0.0124 |

HSC Model: The hot cracking susceptibility (HCS) parameter can be calculated as a product of the crack susceptibility coefficient and the freezing range as follows:

$$HSC = \frac{CSC \times \Delta T}{100}$$

Figure 8:
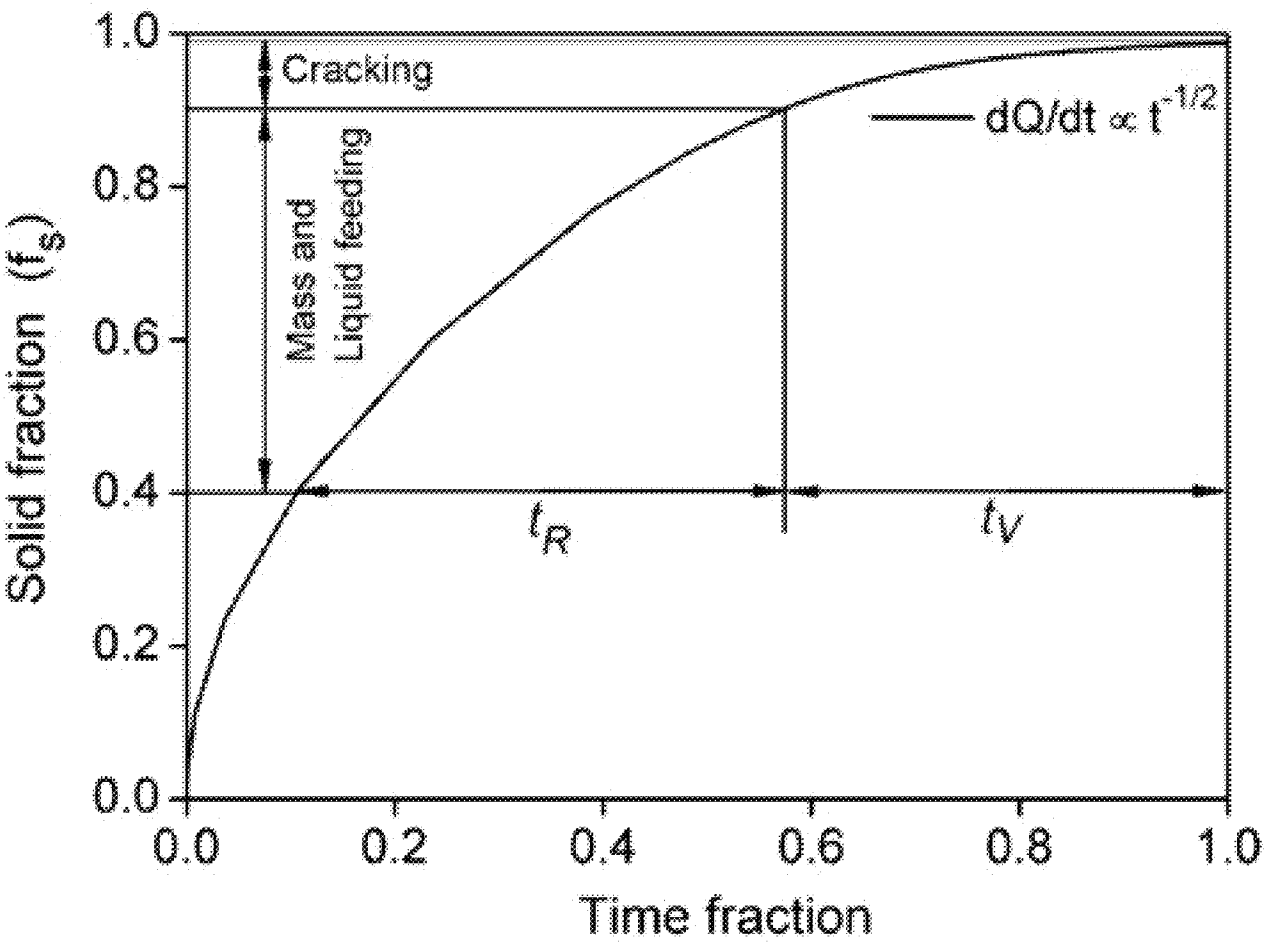
FIG. 8 shows the schematic illustration of relationship between solid fraction and time fraction with stress relief time ($t_R$) and vulnerable time ($t_V$) according to embodiments of the invention.

Scheil solidification simulation is conducted to compute CSC and freezing range using the Thermo-Calc software and a NiTi-based SMAs database developed by QuesTek Innovation LLC. The solidification cracking susceptibility coefficient (CSC) can be calculated by:

$$CSC = \frac{t_V}{t_R}$$

where $t_V$ is the time during solidification in which the casting is vulnerable to cracking, and $t_R$ is the time available for the stress relief process. FIG. 8 shows a schematic illustration of the relationship between solid fraction and time fraction with the stress relief time ($t_R$) and the vulnerable time ($t_V$). The heat flow, dQ/dt during solidification is assumed to be proportional to the square root of time, $$t^{-1/2}\left(\frac{dQ}{dt} \propto t^{-1/2}\right).$$

The stress relief time is defined as the time spent in the range of 40% and 90% solidified (the range over which liquid feeding can easily occur). The vulnerable time is defined as the time spent in the solid fraction range of 0.9 to 0.95-0.99. The vulnerable period and the time available for stress relief processes can be given as:

$$t_V = t_{0.99} - t_{0.9}$$

$$t_R = t_{0.9} - t_{0.4}$$

where t is the time at the specific mass fraction of solid, i.e. $t_{0.99}$ is the time at the mass fraction of solid of 0.99.

The solidification cracking more easily occurs when the solidification temperature range is large increasing the distance (for a given Gibbs free energy) over which the vulnerable zone is extended. The freezing temperature range is defined as the solidification region of mass fraction of solid between 0 and 0.99, and can be expressed as:

$$\Delta T = T_0^s - T_{0.99}^s$$

where ΔT is the temperature difference between a temperature at the solid fraction of 0 ($T_0^s$) and a temperature at the fraction of 0.99 ($T_{0.99}^s$).

Figure 9:
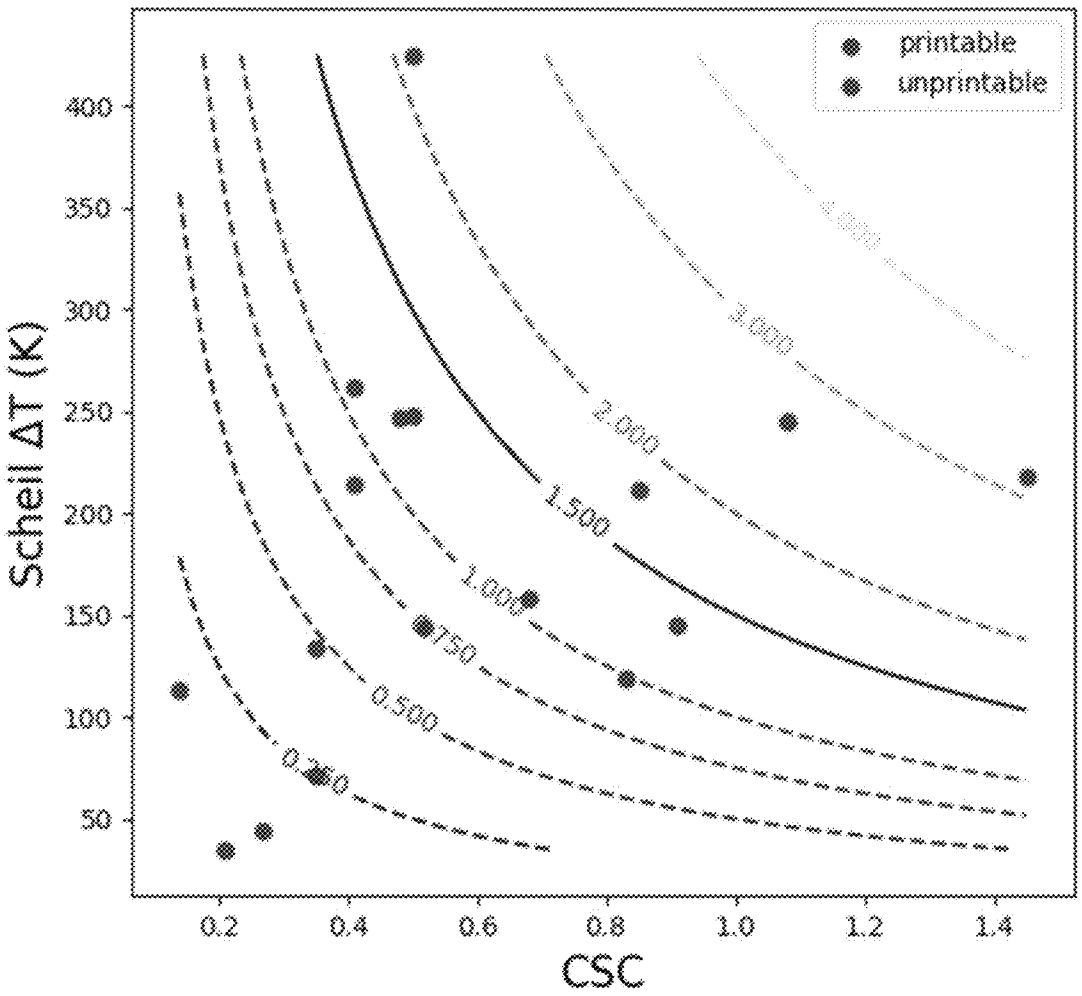
FIG. 9 shows the hot cracking susceptibility (HCS) contour plot vs freezing range (ΔT) and cracking susceptibility coefficient (CSC) for printed alloys in QuesTek LLC, according to embodiments of the invention.

According to the report from QuesTek LLC, the combination of CSC and freezing range is more effective in defining the printability showing in FIG. 9.

Design Results and Predicted Properties

Figure 10:
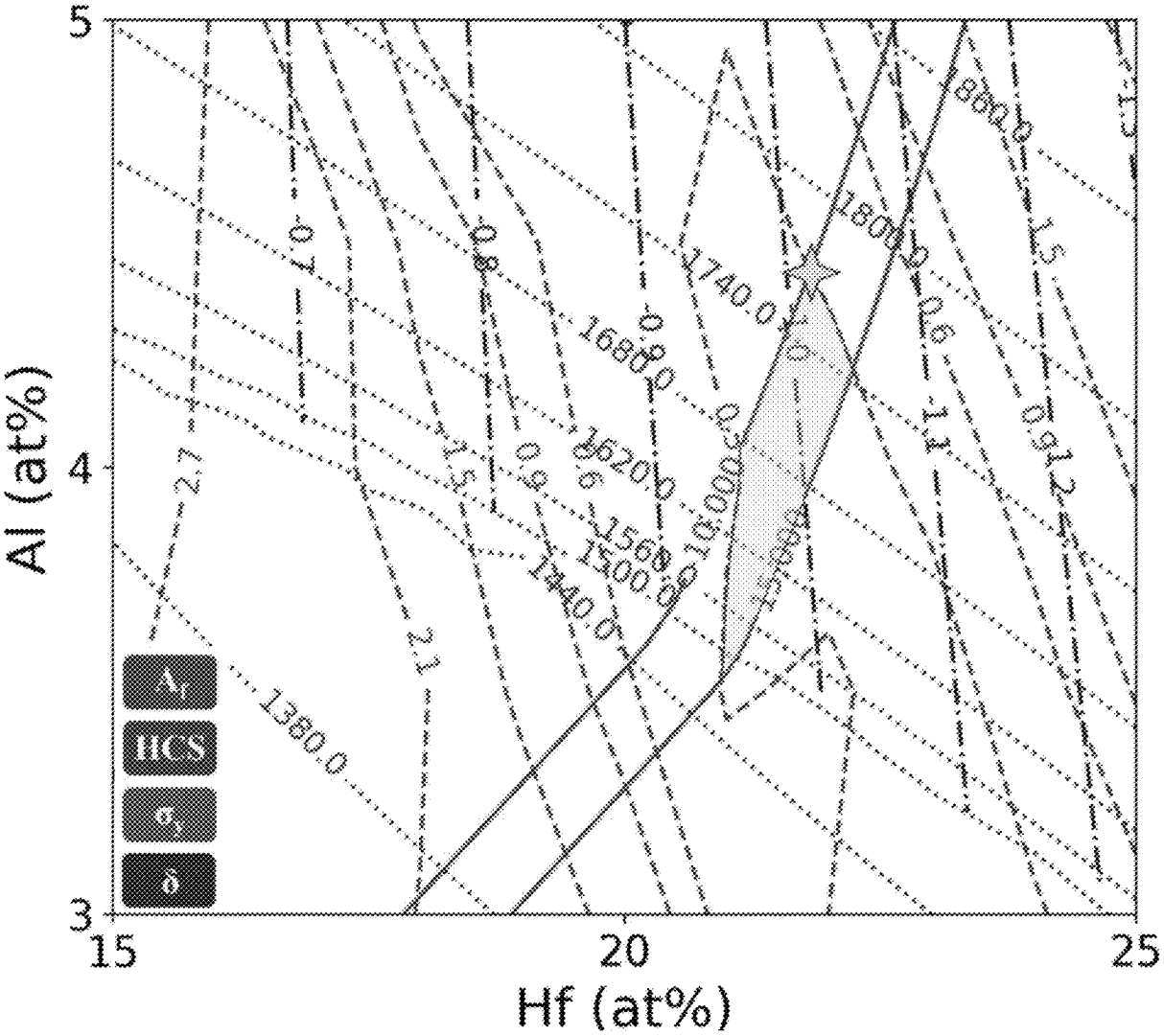
FIG. 10 shows contour plots of Af (° C.) in red, hot cracking susceptibility (HCS) in green, yield strength (MPa) in purple, and misfit (%) in blue as functions of Hf and Al in a $Ni_{50}(Ti, Hf, Al)_{50}$ system, according to embodiments of the invention. A region of compositions satisfying $A_f$ between −10° C. to 15° C. and HCS<0.3 was colored in yellow. A star indicates a final composition maximizing yield strength and minimizing misfit in the range.

The design space was shown in FIG. 10 overlaying contour plots of $A_f$ (° C.) in red, hot cracking susceptibility (HCS) in green, yield strength (MPa) in purple, and misfit (%) in blue as functions of Hf and Al in a $Ni_{50}(Ti, Hf, Al)_{50}$ system. The optimal composition was determined to be $Ni_{50}Ti_{23.6\text{-}24.2}Hf_{21.8\text{-}22}Al_{4\text{-}4.4}$, depending on the desired $A_f$ transformation temperature. The proposed heat-treatment process is: (1) homogenization+solution treatment at 1050° C. for 72 hours followed by water quenching; (2) Aging treatment at 600° C. for 10 hours followed by water quenching. The predicted properties of $Ni_{50}Ti_{23.8}Hf_{21.8}Al_{4.4}$ and $Ni_{50}Ti_{24}Hf_{22}Al_4$ after heat-treatment were shown in Table 6 as follows.

Table 6. Predicted properties in designed $N_{50}Ti_{2.38}Hf_{21.8}Al_{4.4}$ and $Ni_{50}Ti_{24}Hf_{22}Al_4$ alloys

TABLE 5

Predicted properties in designed $Ni_{50}Ti_{23.8}Hf_{21.8}Al_{4.4}$ and $Ni_{50}Ti_{24}Hf_{22}Al_4$ alloys

| Property | Predicted Properties in $Ni_{50}Ti_{23.8}Hf_{21.8}Al_{4.4}$ alloy | $Ni_{50}Ti_{24}Hf_{22}Al_4$ prototype |
|---|---|---|
| Transformation Temperature | $A_f = -10$ (° C.) | $A_f = 15$ (° C.) |
| B2 Yield Strength | $\sigma_y = 1770$ (MPa) | $\sigma_y = \sim 1680$ (MPa) |
| $L2_1$/B2 Misfit | $\delta = 1.02$ (%) | $\delta = 1.03$ (%) |
| Hot Cracking Sensitivity | HCS = 0.3 | HCS = 0.3 |

Experimental Validation

Figure 11:
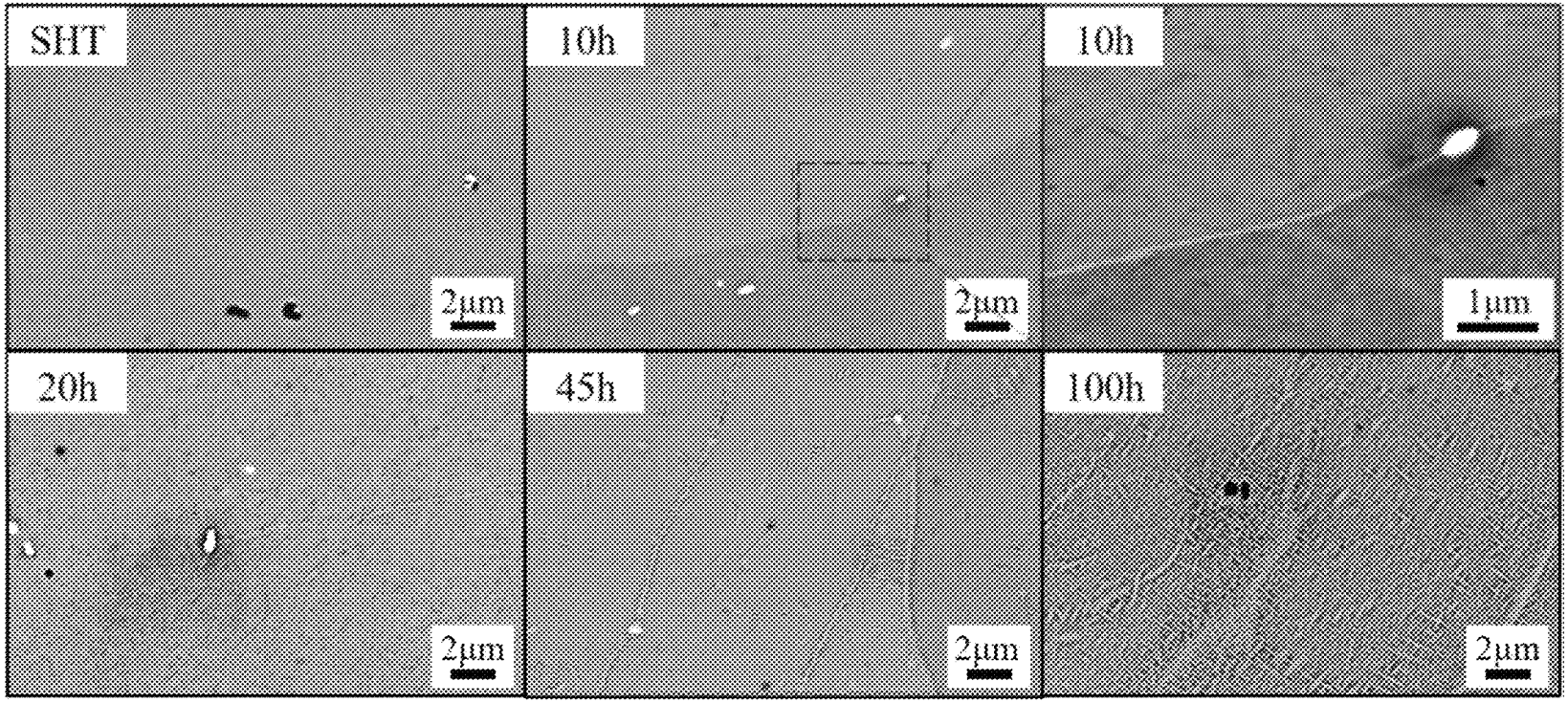
FIG. 11 shows the microstructure evolution of Ni50Ti24Hf22Al4 after aging treatment at 600° C. for 0 h, 10 h, 20 h, 45 h, 100 h, according to embodiments of the invention.
Figure 12:
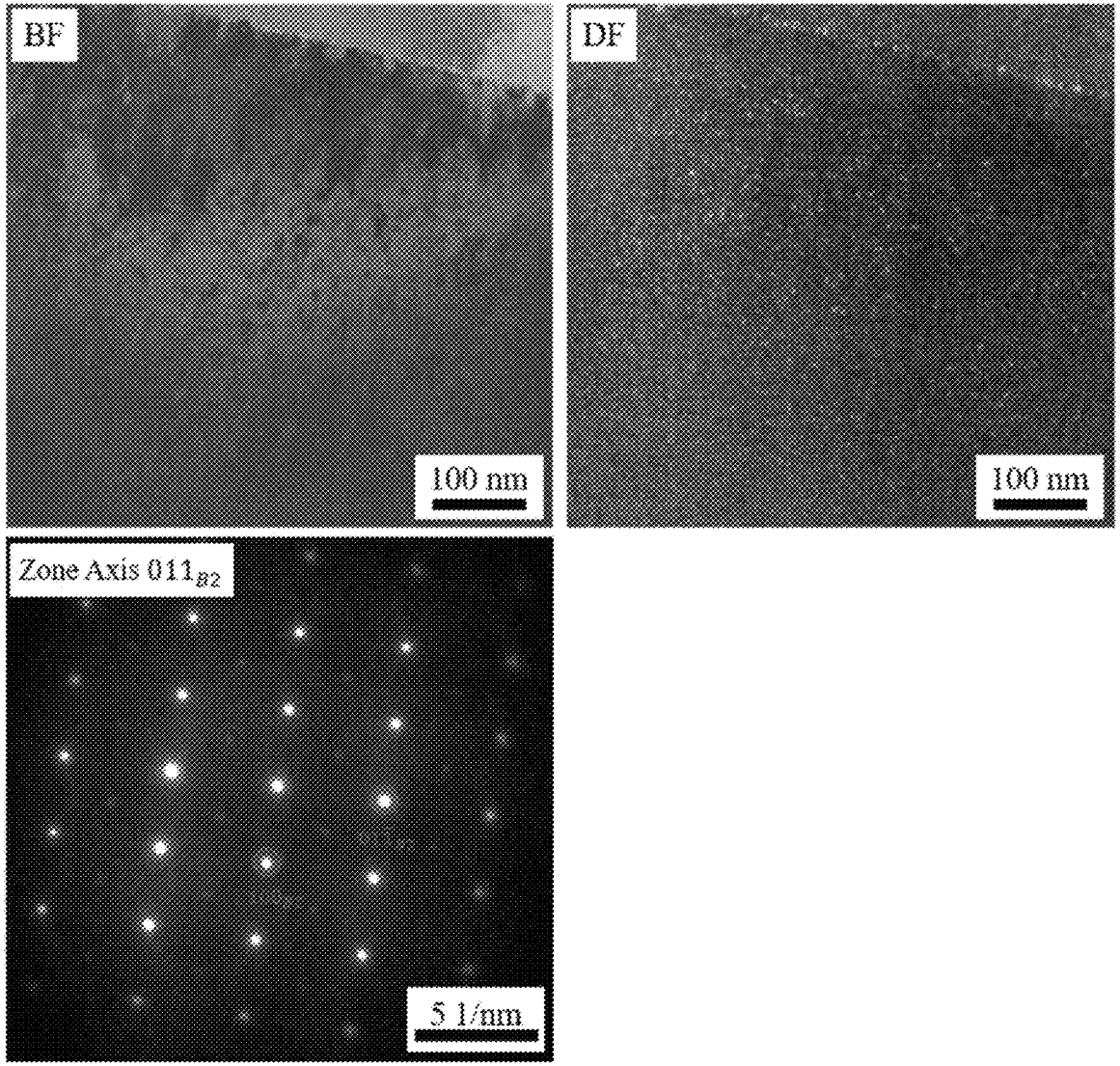
FIG. 12 shows the bright field, dark field images of Ni50Ti24Hf22Al4 aged at 600° C. for 10 h and the corresponding diffraction pattern, according to embodiments of the invention.

Microstructure Characterization: The microstructures of a transforming $Ni_{50}Ti_{24}Hf_{22}Al_4$ alloy aged at 600° C. for 0 h, 10 h, 20 h, 45 h and 100 h were characterized by BSE imaging shown in FIG. 11. Definitely, massive spindle-shaped H-phase particles were found after aging for 100 hours. After aging for 45 hours, a large number of H-phase particles preferentially precipitated on microstructure defects, like grain boundaries, secondary phases. Also, a few large H-phase particle were observed in grain interior. For even shorter aging like 20 hours, the H-phase was still observed at defects but almost no inside grains. As for 10 hours, no H-phase was observed at even higher magnification. Specific attention was paid to microstructure defects like $HfO_2$ particles and grain boundaries where no H-phase precipitate was found. For even higher resolution, TEM imaging was carried out for the $Ni_{50}Ti_{24}Hf_{22}Al_4$ alloy aged for 10 hours shown in FIG. 12. No spindle-shape precipitates were found in the bright-field image. The unique diffraction patterns for B2 and $L2_1$ two-phase structure was observed in FIG. 12. The diffraction spots of $L2_1$ precipitates were slightly fuzzy due to the relatively small phase fraction. In dark-field imaging, a large amount of bright $L2_1$ particles were observed as fine as 2-3 nm in grain interior with some coarse ones on the grain boundary. It is concluded that $Ni_{50}Ti_{24}Hf_{22}Al_4$ aged at 600° C. for 10 h is of a B2-$L2_1$ two-phase structure.

Figure 13:
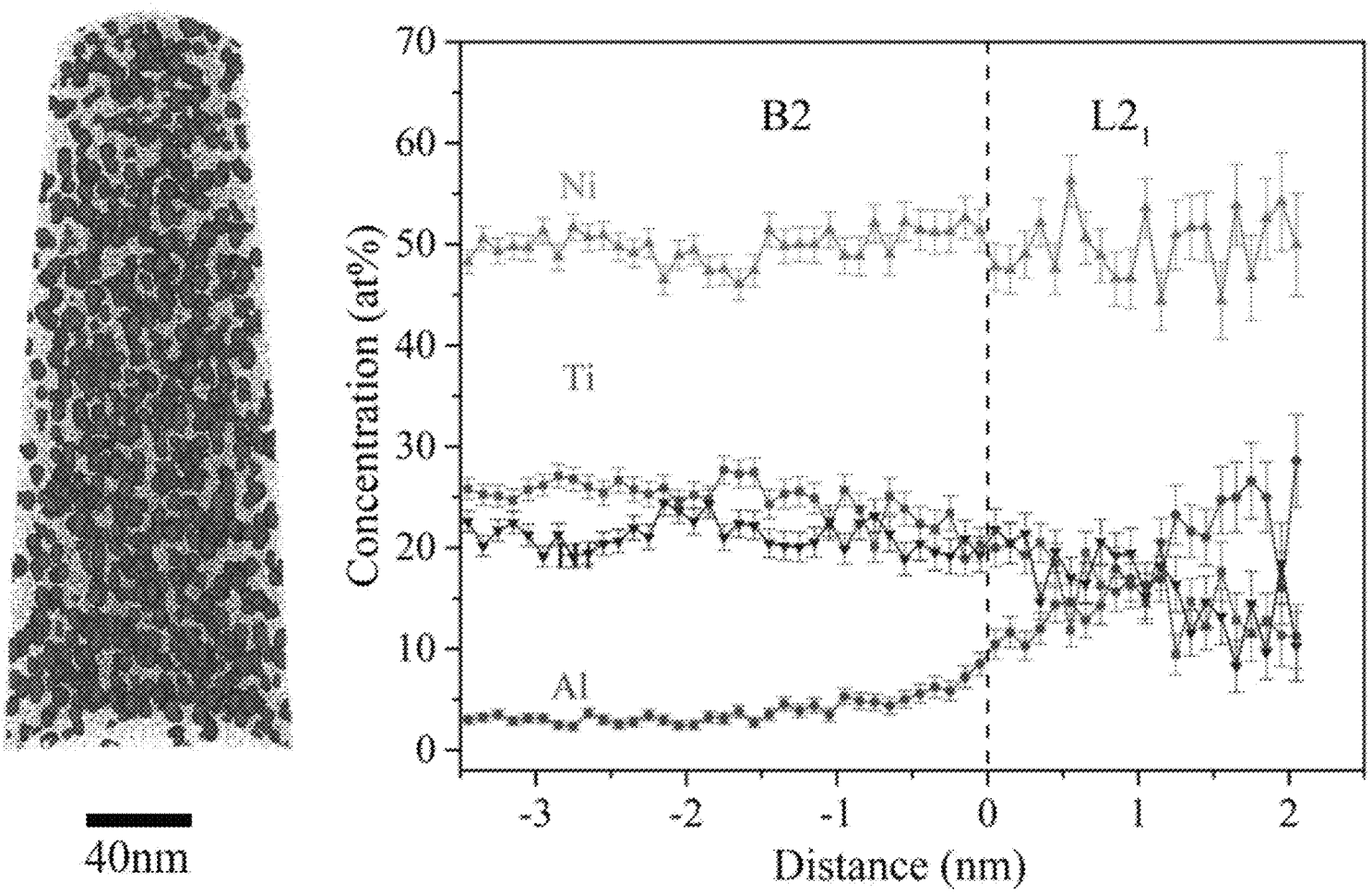
FIG. 13 shows the APT 3D-reconstruction of Ni50Ti24Hf22Al4 aged at 600° C. for 10 h and the corresponding proxigram of B2-L21 interface according to embodiments of the invention.

To further reveal the nanoscale elements distribution of the B2-$L2_1$ two-phase structure, the APT analysis was conducted for aged $Ni_{50}Ti_{24}Hf_{22}Al_4$ alloys at 600° C. for 10 h. The 3D-reconstruction from this analysis was shown in FIG. 13. No spindle-shaped precipitates or Hf-rich particles were found from the reconstruction but only a population of Al-rich nanoparticles embedded in the matrix, confirming the B2-$L2_1$ two phase structure for short time aging at 600° C. The $L2_1$ precipitates were confirmed to be poor in Ti and Hf but much richer in Al. The Ni content of $L2_1$ precipitates was of larger spatial fluctuation from our analysis but the average Ni content is still about 50%, the same with the bulk composition. The compositions of two phases is approximated as $Ni_{50}Ti_{24.4}Hf_{22.4}Al_{3.2}$ for the B2 matrix and $Ni_{50}Ti_{15}Hf_{14.5}Al_{20.5}$ for the $L2_1$ precipitates. The average particle size of the $L2_1$ precipitates was ~1.7 nm with slight uncertainty due to the analysis methods. The total volume fraction of the $L2_1$ precipitates was about 4.2%, a little lower than expected but is still effective in terms of precipitation strengthening.

Figure 14:
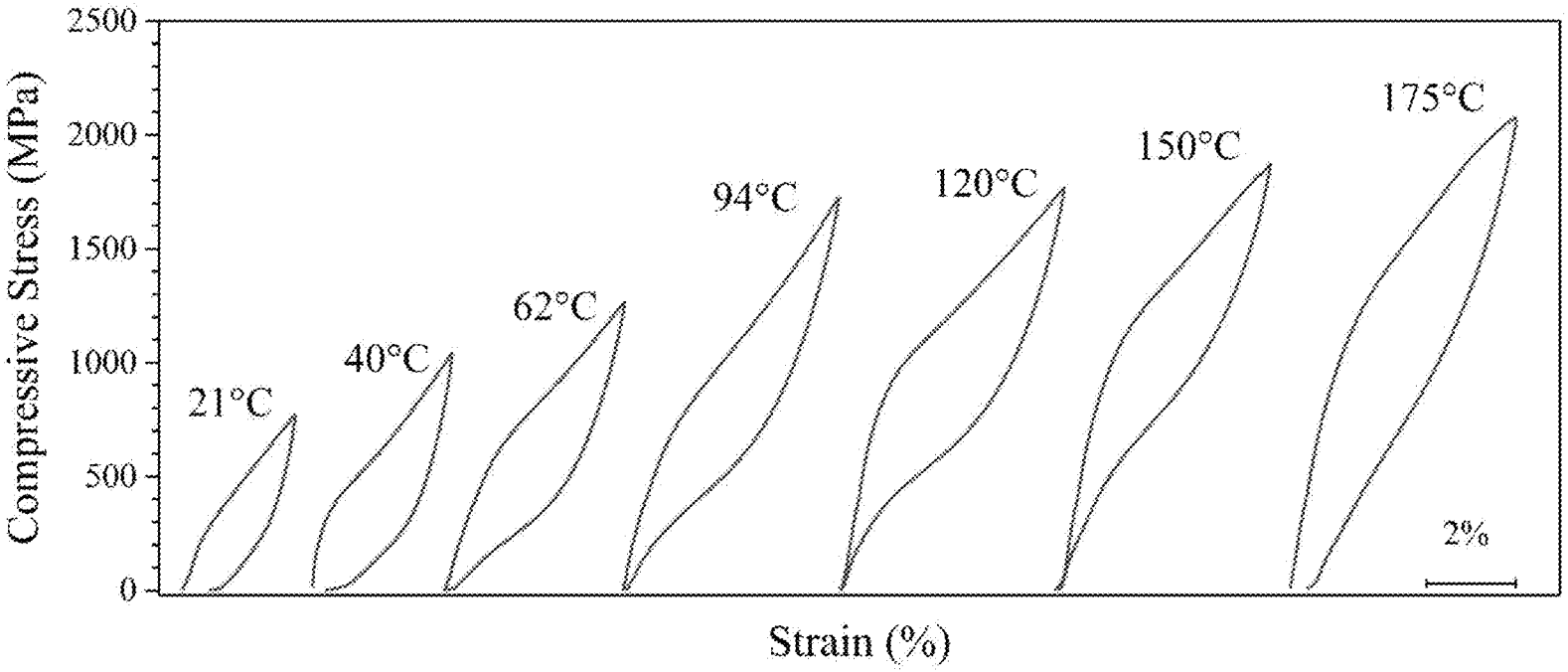
FIG. 14 shows the compressive stress-strain curves of peak-aged Ni50Ti24Hf22Al4 at various temperatures: 21° C., 40° C., 62° C., 94° C., 120° C., 150° C., 175° C. Superelasticity was confirmed at all test temperatures according to embodiments of the invention.
Figure 15:
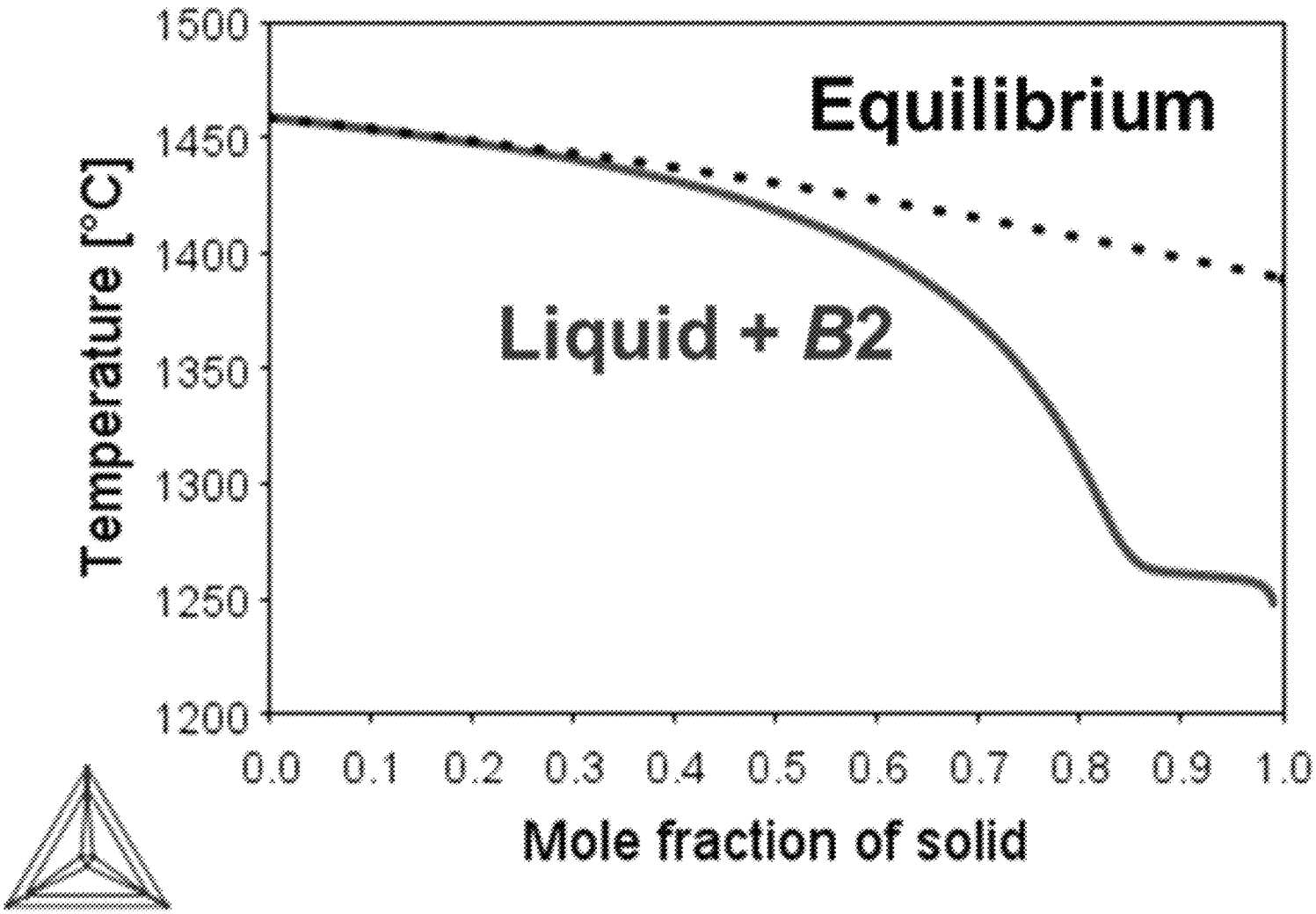
FIG. 15 shows a solidification curve in a $Ni_{50}Ti_{23.8}Hf_{21.8}Al_{4.4}$ alloy calculated by Scheil simulation according to embodiments of the invention.

Phase Transformation Characterization: The thermal transformation behavior of a $Ni_{50}Ti_{24}Hf_{22}Al_4$ alloy after aging at 600° C. was shown in FIG. 14. At this aging temperature, transformation temperature increased with longer aging time. Alloying with Al is known to be significantly suppress martensitic transformation. While the Heusler phase precipitated in the B2 matrix, the Al content decreased, resulting increases in transformation temperatures. Actually, the alloy aged 600° C. for 100 hours was of no transformation peak in a wide temperature range. This phenomenon is attributed to the massive precipitation of H-phase particles after aging at 600° C. for 100 hours. These large H-phase particles prevented interface movement and, therefore, increased the friction work for martensite nucleation. In contrast, the transformation temperatures continued increasing after aging at 650° C. from 45 hours to 100 hours as there were a few H-phase particles observed by electron microscopes.

Though transformation temperatures increased with aging time monotonously, the transformation stability was found to be improved only with 10-20 hours aging by observing the transformation shift during cycling. The best stability was achieved by aging at 600° C. for 10 hours and its reverse transformation peak only shifted less than 0.5° C. from the first to the third cycle.

Mechanical Characterization: As the thermal transformation behavior has been characterized in solution treated and aged $Ni_{50}Ti_{24}Hf_{22}Al_4$ alloys, it is critical to characterize the mechanical transformation behavior, especially superelasticity applied in most medical and industrial applications. Due to the capacity of our arc melter, only small ingots is prepared as less than 500 g, and the compression with small cylinder was selected to save materials.

An initial trial was taken to measure the stress-strain curve of peak-aged $Ni_{50}Ti_{24}Hf_{22}Al_4$ alloys (600° C./10 h) was carried out at room temperature. While the strain recovered after unloading, the residual strain was pretty distinct as well. Rather than plastic deformation, it was attributed the increase transformation temperature in peak-aged condition ($A_f$=20° C.). In case, a series of compression tests were conducted at various elevated temperatures from 40° C. to 175° C. The stress-strain curves were shown in FIG. 14. Nearly perfect superelasticity was confirmed at temperature from 62° C. to 150° C. with negligible residual strain. For the test at 175° C., plastic deformation was slight introduced with a peak stress of 2.1 GPa, leaving a residual strain of 0.33% upon unloading. The yield stress was determined to be 2.0 GPa, about 400 MPa higher than the solution treated condition.

The temperature dependence of the critical transformation stress for this peak-aged $Ni_{50}Ti_{24}Hf_{22}Al_4$ alloy is determined from compression test at various temperatures. The critical transformation stress was obtained from the stress-strain curve as the cross point of tangent lines for the elastic part and the phase transformation part. By a linear fitting, the slope of temperature dependence was about 6.5 MPa/° C. For NiTi, the temperature dependence of critical transformation stress is 5-8 MPa/° C. for tension and 12 MPa/° C. for compression. In a Ni-rich NiTiHf high temperature shape memory, the slope is 7-9 MPa/° C. depending on aging condition. According to the modified Clausius-Clapeyron equation, the temperature dependence is expressed as $$\frac{d\sigma_{cr}}{dT} = -\frac{\Delta S}{\varepsilon} = -\frac{\Delta H^*}{\epsilon T}$$

where $\sigma_{cr}$ is the critical stress for transformation, ε a transformation strain depending on the crystal orientation, $\Delta S=S_M-S_A$ the entropy of transformation per unit volume, and ΔH* the enthalpy of transformation per unit volume. The entropy of transformation, ΔS, is roughly estimated from the heat flow measurement of DSC. The transformation entropy of the peak-aged $Ni_{50}Ti_{24}Hf_{22}Al_4$ alloy was about 14 J/(Kg*K), much smaller than that of NiTi SMAs (65 J/(Kg*K)).

The combination of high yield strength and low temperature dependence of critical stress yields a wide range of superelasticity. The temperature range of proper superelasticity is estimated as $A_f-M_s^{\sigma}$. And $M_s^{\sigma}$ is calculated by solving the following equation:

$$\sigma_{yield}(T=M_s^{\sigma})=\sigma_{cr}(T=M_s^{\sigma})$$

where $\sigma_{yield}$ is the temperature-dependent yield strength of austenite, and $\sigma_{cr}$ is the critical stress to trigger martensitic transformation as a function of temperature.

Assuming an invariant yield strength with temperature, 2.0 GPa, the $M_s^{\sigma}$ was calculated to be 327° C. for the peak-aged $Ni_{50}Ti_{24}Hf_{22}Al_4$ alloy. In contrast, there was no superelasticity at 120° C. for as-cast NiTi SMAs.

Figure 16:
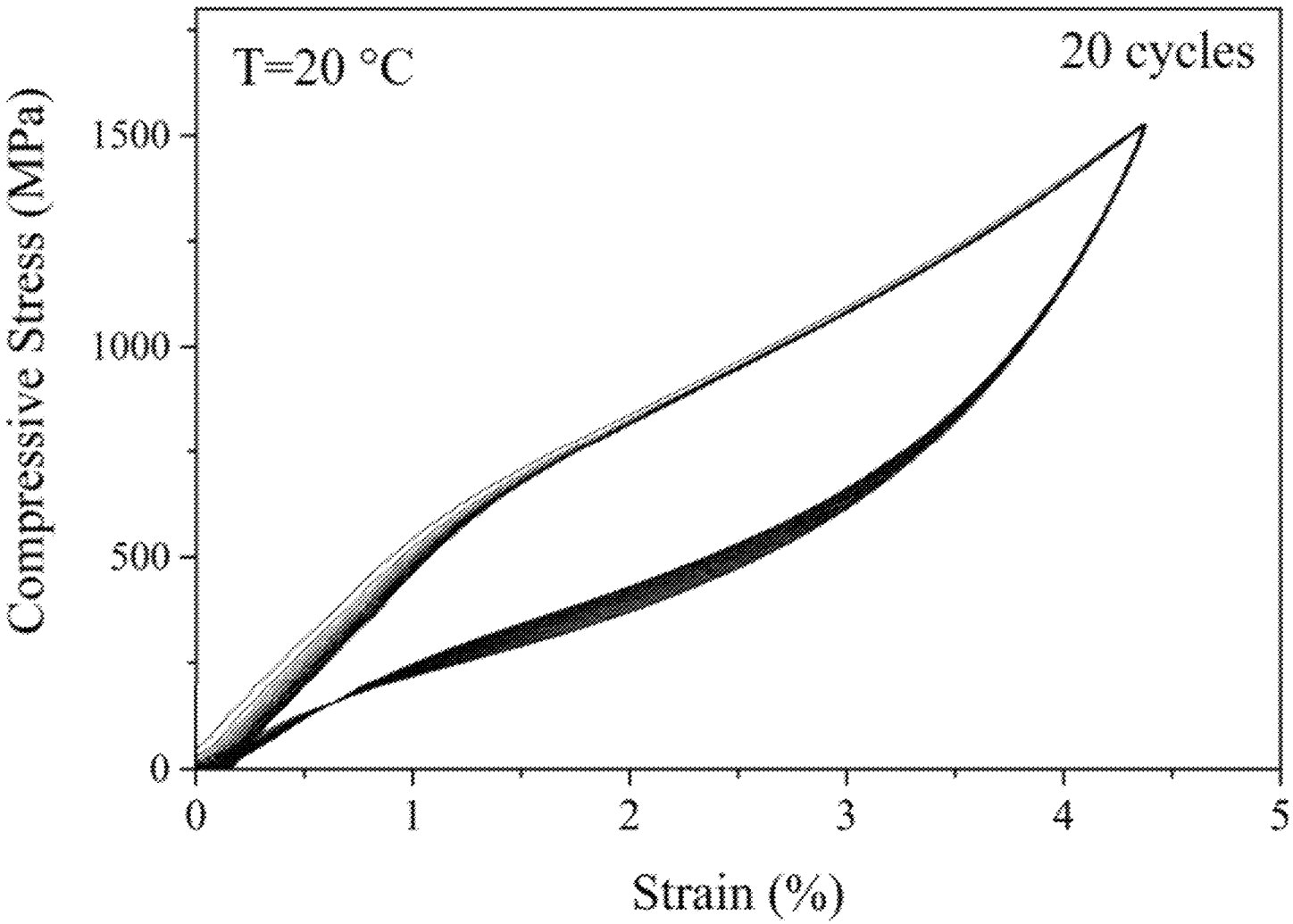
FIG. 16 shows the 20-cycles compressive response of a $Ni_{50}Ti_{23.8}Hf_{21.8}Al_{4.4}$ aged at 600° C. for 10 hours according to embodiments of the invention.

A preliminary compression test at room temperature was also conducted on the other design prototype—$Ni_{50}Ti_{23.8}Hf_{21.8}Al_{4.4}$ alloy processed by solution treatment and then aged at 600° C. for 10 hours. This design prototype was of complete superelasticity at room temperature as shown in FIG. 16. The cyclic stability was also remarkable for this alloy—only 0.2% residual strain after 20 cycles to a peak stress of 1.7 GPa. And the fully recoverable strain is as high as 4% after cycling.

Figure 17:
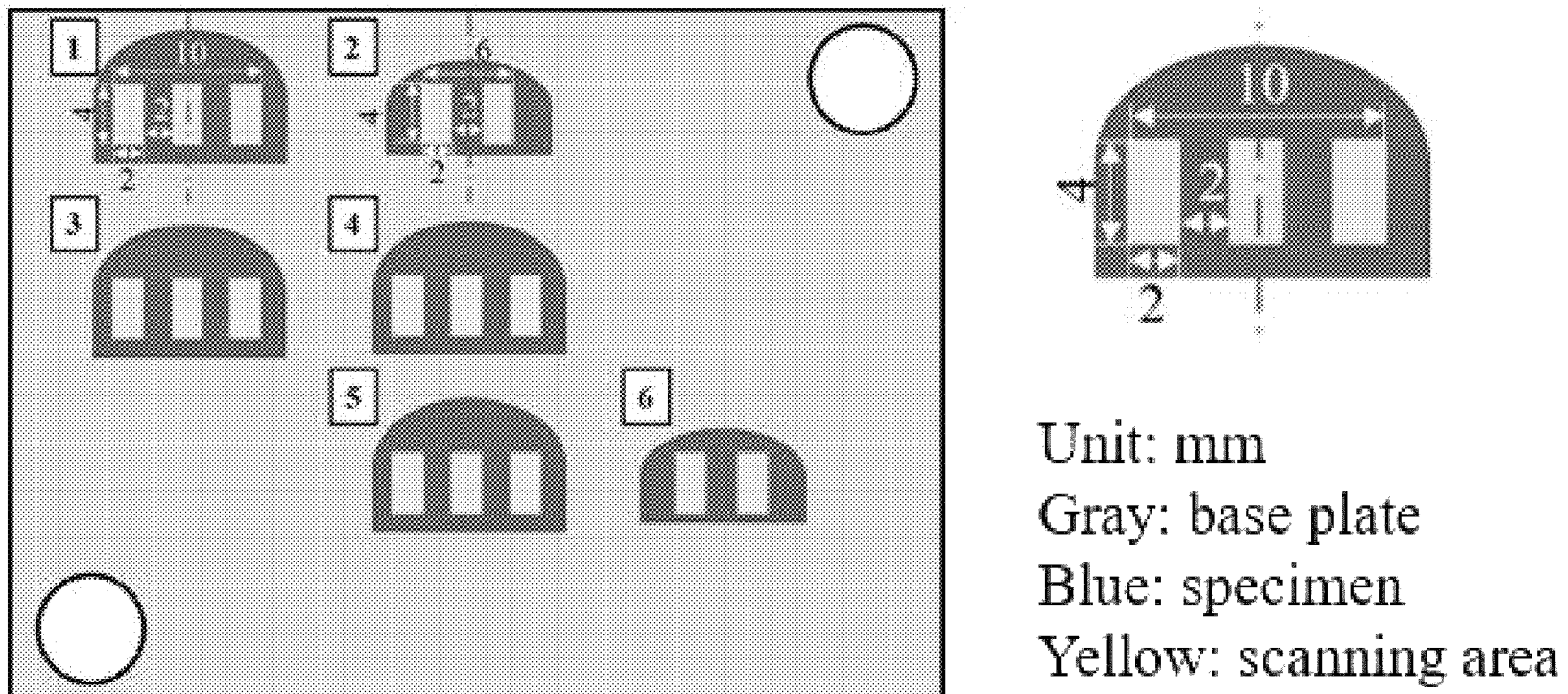
FIG. 17 shows the schematic of specimen distribution for laser scanning according to embodiments of the invention.

Printability Evaluation: Nominal composition of the alloys chosen for laser scanning was $Ni_{50}Ti_{24}Hf_{22}Al_4$. High purity elemental materials of Ni (99.98 wt. %), Ti (99.98 wt. %), Hf (99.9 wt. %) and Al (99.999 wt. %) were used as raw materials for vacuum arc melting of these two alloys (~10 g) under Argon atmosphere. To ensure the homogeneity, they were remelted for at least five times. And then they were encapsulated in quartz tubes filled by high purity Argon and heat-treated at 1000 C for 24 h followed by water quenching. The as-homogenized ingots were cut into 1 mm thick plates. These plates were grinded by 1200 grid SiC paper to achieve parallel and smooth surfaces and then mounted on large Al base plates for laser scanning in EOS M280 selective laser melting machine. The distribution of plate specimens on the base plates was shown in FIG. 17.

To study the effect of processing parameters on microstructure, different levels of laser power (150, 200, 250 W) and scanning speed (250, 500, 750, 1000, 1500 mm/s) were selected for laser scanning experiments with fixed beam diameter (0.1 mm) and hath spacing (0.1 mm). The global energy density (GED) and the energy level (E) is calculated by following equations:

$$GED = \frac{P}{v \times h}$$

and $$E = \frac{P}{v \times h \times t}$$

where P is laser power, v is scanning speed, h is hatch spacing, and t is the layer thickness (supposed to be 30 μm in calculations). The parameters for all scanning were presented in Table 6. With combinations of varying laser power and scanning speed, the range of GED and E is as large as 1-13.33 J/mm2 and 33.3-444.4 J/mm$^3$ respectively.

Figure 18:
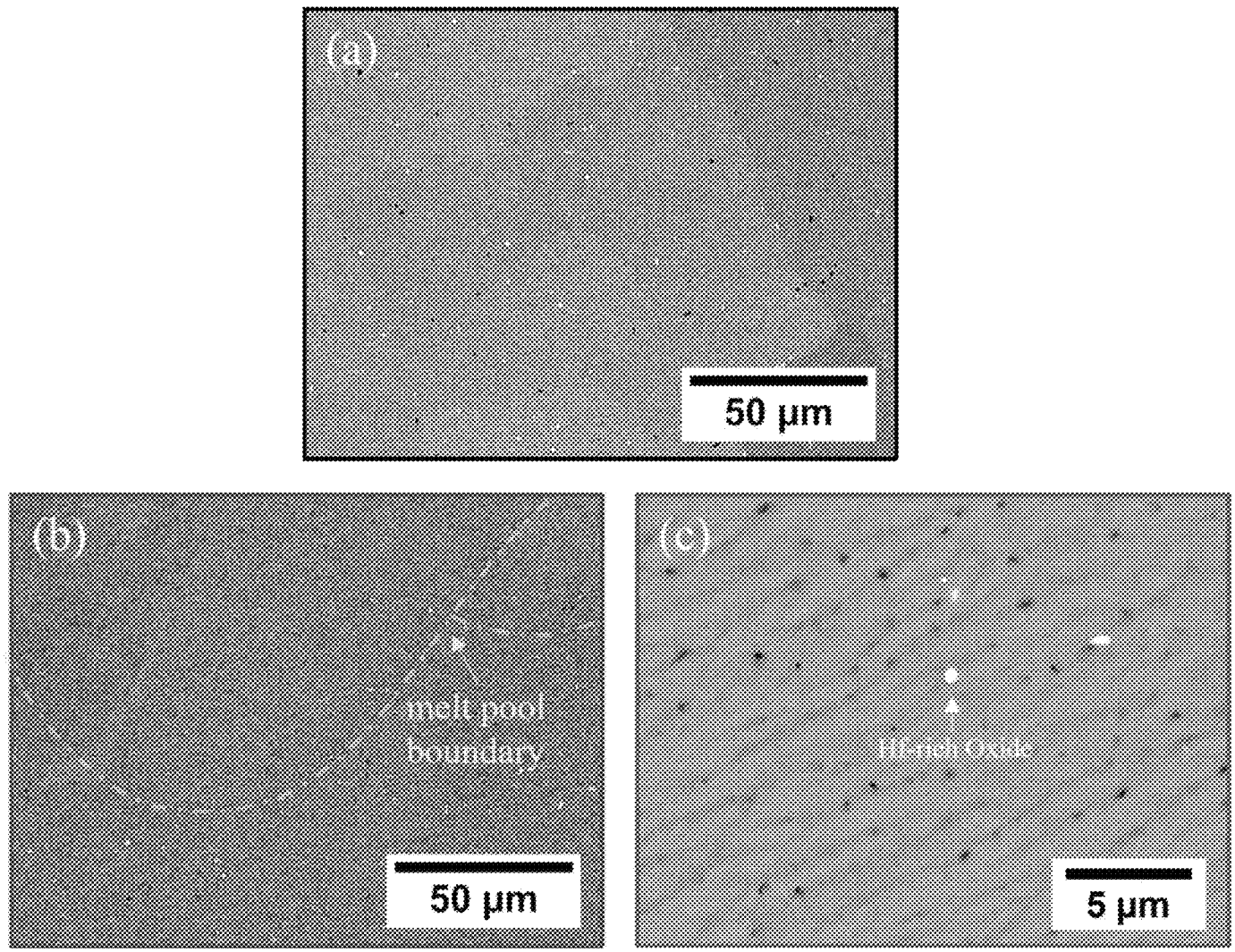
FIG. 18 shows the backscattering electron images of NiTiHfAl microstructure before laser scanning (panel a) and after laser scanning (panel b) and (panel c), according to embodiments of the invention.
Figure 19:
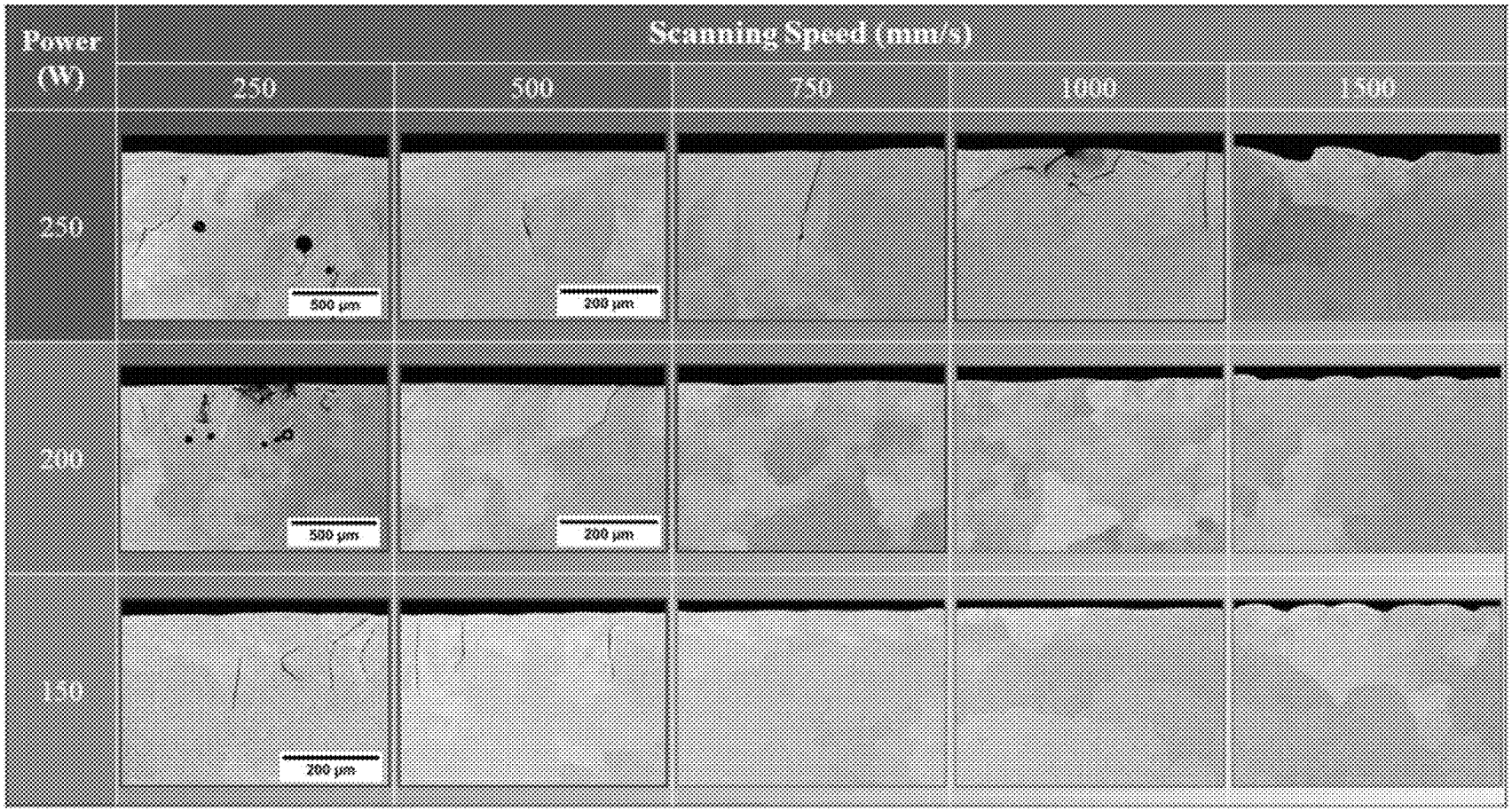
FIG. 19 shows the side view microstructure of laser-scanned specimens with various scanning parameters according to embodiments of the invention.
Figure 20:
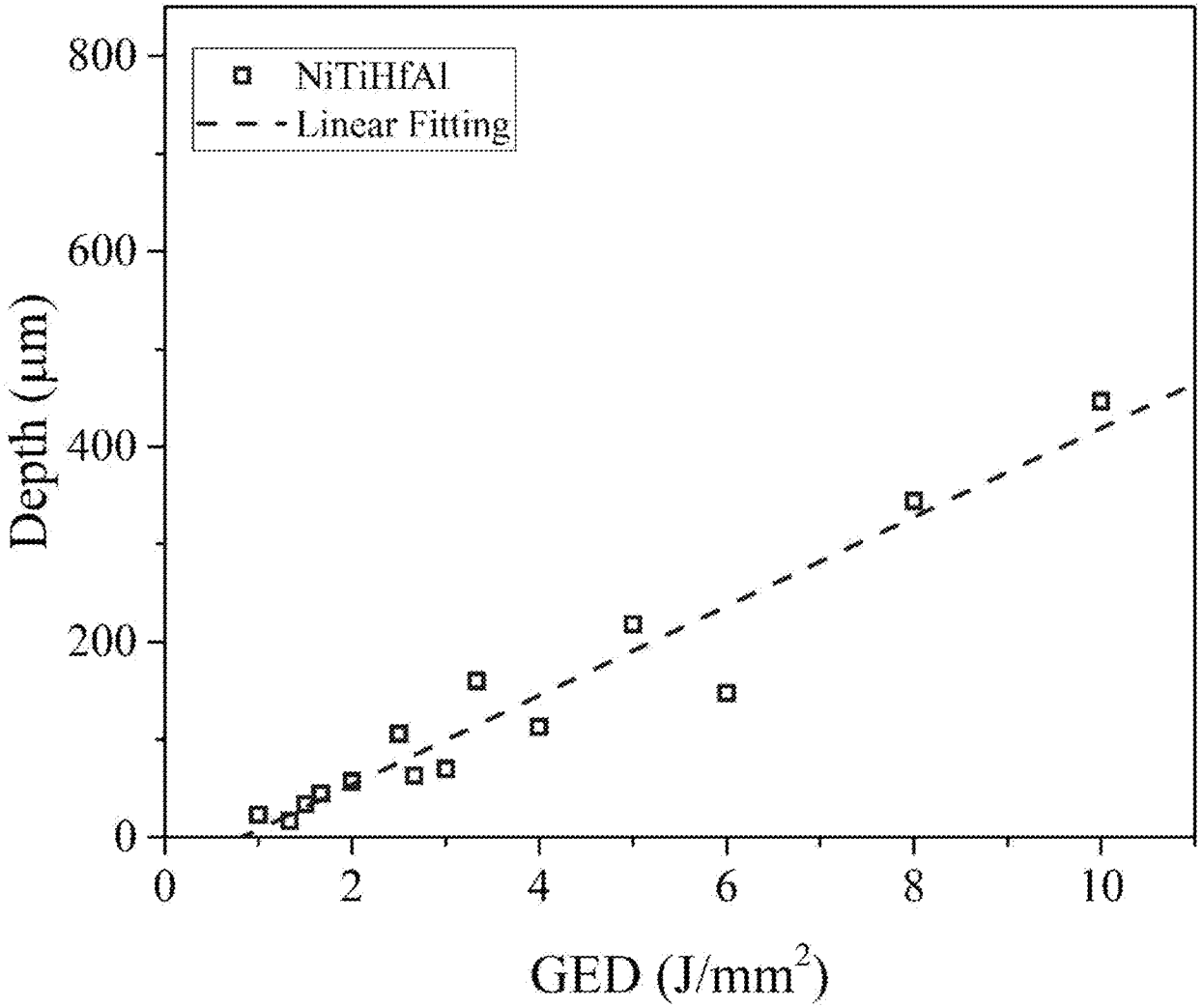
FIG. 20 shows the relationship between depth of melt pools and general energy density for NiTiHfAl alloys according to embodiments of the invention.

The original microstructure of these two alloys before laser scanning was revealed by backscattering electron microscope characterization as shown in FIG. 18. The matrix was identified to be polycrystal B2 austenite with submicron-scale dark and white particles. As similar with other NiTiHf-based alloys, the dark ones were $(Ti,Hf)_2Ni$ type particles as Hf usually substitutes Ti atoms in NiTi B2 phase. The white particles are more likely to be Hf-rich oxides like $HfO_2$ that have also been discovered in Ni-rich NiTiHf high temperature SMAs. The as-scanned microstructure is quite different depending on laser power and scanning speed as shown in FIG. 19. Previous high speed x-ray imaging of interaction between laser scanning and metallic materials showed that vapor depressions (also known as keyholes) are present across a large range of power and scanning velocity used in laser powder bed fusion. The residual pores, however, depends on the keyhole depression depth: at small depth, the flat and shallow keyholes are very likely to recover after laser scanning; at large depth, the tip of steep keyholes is captured as pore by the liquid by separating it from the main keyholes. This tendency has also been observed in our specimens. At large power and low scanning speed, the power density is much larger, resulting in deeper drill into these specimens. As shown in FIG. 19, most pores were found in specimens with high energy density. It should be mentioned here that those bright particles in pores were contaminants introduced during polishing process. At low energy density with low power and high scanning speed, the melt pool boundaries were much shallower. A rough linear relationship is established between power density and depth of melt pools as shown in FIG. 20. The slope of NiTiHfAl curve is relatively smaller than that of PdNiTiAl. It is hard to explain this difference quantitatively, but one possible reason is their difference in heat conductivity. In the additive manufacturing, lack of fusion is another common defect found between layers of specimens with low power density. Obviously, this defect could not be found in single scanning pass experiments. Considering the typical layer thickness of 30 μm, a threshold was determined to be 60 μm for the depth of melt pools to ensure each scan could remelt the new lay and the last layer together.

Apart from these similarities, NiTiHfAl SMAs is different from PdNiTiAl SMAs as we observed micro-scale cracks in some NiTiHfAl specimens which were not present in any PdNiTiAl specimens. A potential reason to this phenomenon is the low ductility of NiTiHfAl alloys. It was known that strong solid solution by Hf additions could reduce the ductility of NiTi-based alloys while Pd additions soften NiTi B2 phase.

Figure 21:
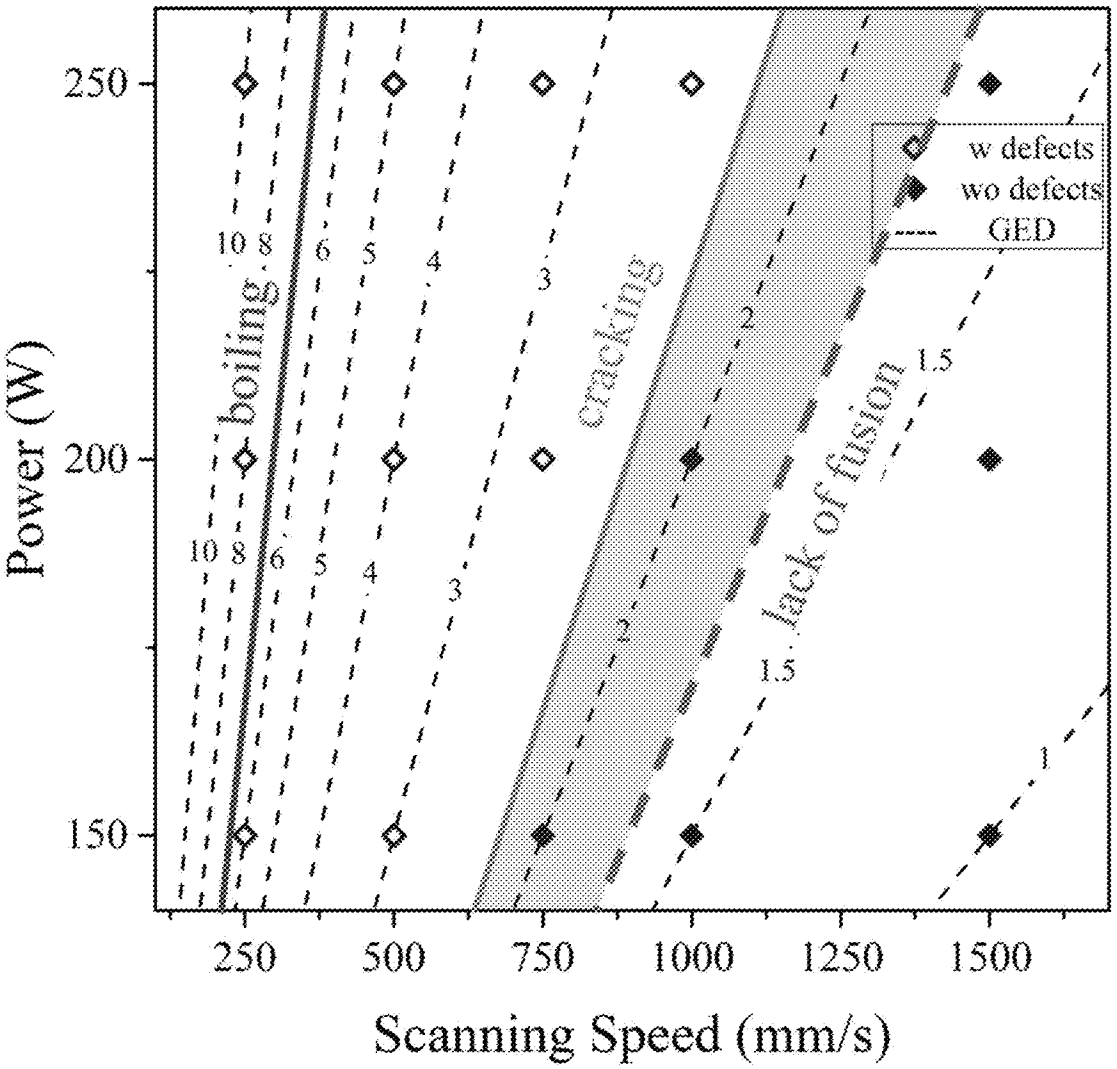
FIG. 21 shows the laser scanning parameter map for NiTiHfAl SMAs according to embodiments of the invention.

With the microstructure characterization and the threshold definition of lack of fusion, we can give a map for laser scanning parameter in NiTiHfAl SMAs. These regions for different microstructure are well separated by the definition of general energy density as shown in FIG. 21. For NiTiHfAl SMAs, however, the processing window was pretty narrow as the threshold energy density of cracking was quite close to that of lack of fusion. The actual additive manufacturing is different from our laser scanning in term of powder shape, cooling rate and so on. Further printability assessment is supposed to be conducted for NiTiHfAl alloys. Overall, NiTiHfAl is supposed to be printable according to our current results of laser scanning experiments.

While these defects are produced by laser scanning depending on scanning parameters, the microstructure of matrix phase and secondary phase like $Ti_2Ni$ particles changed as well as they experienced remelting and solidification during scanning. In the micrographs of FIG. 18, the microstructure in the melt pool seems quite similar with unmelted region as they include multiple austenite grains. The melt pool, however, looks much cleaner than unmelted region as those dark $Ti_2Ni$ particles were refined during laser scanning. At a high magnification, we can confirm the dispersion of $Ti_2Ni$ particles with diameter less than 50 nm in the austenite matrix, near-eutectic structure of matrix B2 phase and $Ti_2Ni$ phase. The white particles, Hf oxides, behaved differently from $Ti_2Ni$ phase as they are relatively large around the melt pool boundaries. They were likely to remain unmelted during laser scanning considering their higher melting temperature (2758° C.) than $Ti_2Ni$ (984° C.). The refinement of secondary particles is beneficial to the final fatigue performance as mentioned before, which encourages our application of additive manufacturing in NiTi-based SMAs processing.

CONCLUSION

A systematic design approach was employed in the development of precipitation-strengthened NiTi-based shape memory alloys for additive manufacturing. And the design prototypes were evaluated by experimental characterization of microstructure evolution, phase transformation behavior, mechanical responses and printability.

The foregoing description of the exemplary embodiments of the present invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

Some references, which may include patents, patent applications, and various publications, are cited and discussed in the description of this invention. The citation and/or discussion of such references is provided merely to clarify the description of the invention and is not an admission that any such reference is "prior art" to the invention described herein. All references cited and discussed in this specification are incorporated herein by reference in their entireties and to the same extent as if each reference was individually incorporated by reference.

What is claimed is:

1. A precipitation-strengthened shape memory alloy (SMA), comprising:

a composition designed and processed such that the precipitation-strengthened SMA meets property objectives comprising a yield strength being more than about 1500 MPa at room temperature, a transformation temperature in a range of about −15 to 20° C. misfit in a range of about 0.9-1.1%, wherein the property objectives are design specifications of the precipitation-strengthened SMA;

wherein the precipitation-strengthened SMA comprises an $Ni_{50}Ti_{23.8}Hf_{21.8}Al_{4.4}$ alloy that is superelastic at room temperature; and wherein the yield strength is about 1770 MPa at room temperature, the transformation temperature is about −10° C., the misfit about 1.02% and the hot cracking sensitivity about 0.3.

2. The precipitation-strengthened SMA of claim 1, wherein the composition is processed with a heat-treatment process including homogenization and solution treatment at about 1050° C. for about 72h followed by water quenching; and aging treatment at about 600° C. for about 10h followed by water quenching.

3. The precipitation-strengthened SMA of claim 1, having a maximum recoverable strain about 4.2% in a wide temperature range from room temperature to about 175° C.

4. A precipitation-strengthened shape memory alloy (SMA), comprising:

a composition designed and processed such that the precipitation-strengthened SMA meets property objectives comprising a yield strength being more than about 1500 MPa at room temperature, a transformation temperature in a range of about −15 to 20° C., a misfit in a range of about 0.9-1.1%, wherein the property objectives are design specifications of the precipitation-strengthened SMA;

wherein the precipitation-strengthened SMA comprises an $Ni_{50}Ti_{24}Hf_{22}Al_4$ alloy;

and wherein the yield strength is about 1680 MPa at room temperature, the transformation temperature is about 15 the misfit about 1.03%, and the hot cracking sensitivity about 0.3.

5. The precipitation-strengthened SMA of claim 4, wherein the $Ni_{50}Ti_{24}Hf_{22}Al_4$ alloy aged at about 600° C. for about 10h is of a B2-$L2_1$ two-phase structure.

* * * * *